US005922233A

United States Patent [19]

Ohashi et al.

[11] Patent Number: 5,922,233

[45] Date of Patent: Jul. 13, 1999

[54] HEATER AND MANUFACTURING METHOD THEREOF

[75] Inventors: Keiichi Ohashi, Shizuoka; Tetsuo Yamaguchi, Shiki-gun; Fumitaka Ishimori, Yamatokooriyama, all of Japan

[73] Assignees: Sekisui Kasethin Kogyo Kabushiki Kaisha, Osaka; Keiichi Ohashi, Shizuoka, both of Japan

[21] Appl. No.: 08/793,746

[22] PCT Filed: Sep. 14, 1995

[86] PCT No.: PCT/JP95/01829

§ 371 Date: Mar. 12, 1997

§ 102(e) Date: Mar. 12, 1997

[87] PCT Pub. No.: WO96/08613

PCT Pub. Date: Mar. 21, 1996

[30] Foreign Application Priority Data

| | | | |
|---|---|---|---|
| Sep. 14, 1994 | [JP] | Japan | 6/220188 |
| Feb. 27, 1995 | [JP] | Japan | 7/38807 |
| Mar. 17, 1995 | [JP] | Japan | 7/59505 |
| Mar. 17, 1995 | [JP] | Japan | 7/59512 |

[51] Int. Cl.[6] ..... H05B 3/34; H01C 3/04

[52] U.S. Cl. ..... 219/528; 338/26

[58] Field of Search ..... 219/528, 540, 219/541, 544, 505, 549; 338/212, 211, 214, 275, 306, 322, 333; 174/84 R, 84 C, 91, 94 R, 268

[56] References Cited

U.S. PATENT DOCUMENTS

| | | | |
|---|---|---|---|
| 2,982,932 | 5/1961 | Morey | 338/212 |
| 3,976,854 | 8/1976 | Ishikawa | 219/540 |
| 4,072,848 | 2/1978 | Johnson | 219/528 |
| 4,638,150 | 1/1987 | Whitney | 219/543 |
| 5,198,794 | 3/1993 | Sato | 338/306 |
| 5,245,161 | 9/1993 | Okamoto | 219/549 |

FOREIGN PATENT DOCUMENTS

| | | |
|---|---|---|
| 0 287 898 | 10/1988 | European Pat. Off. . |
| 62-184686 | 11/1987 | Japan . |
| 2-12789 | 1/1990 | Japan . |

*Primary Examiner*—Teresa Walberg
*Assistant Examiner*—Daniel Leon Robinson
*Attorney, Agent, or Firm*—Nidaido Marmelstein Murray & Oram LLP

[57] ABSTRACT

In the case where a heater main body (1) is bent so as to be wound around a subject to be heated such as a water pipe, etc., a heater can stably heats the subject to be heated. A plurality of heating elements (2), which are composed of ceramics as positive-characteristic thermistors and have electrodes on both sides of the heating elements, are sealed along a lengthwise direction of the heater main body (1) with flexibility and electrical insulation at intervals. Pairs of feeders (3) for feeding electricity to the heating elements (2) are provided to the heater main body (1). A holder (5) having electrical conductivity is provided into the heater main body (1) so as to connect the heating elements (2) to the feeders (3) and retain them. The holder (5) reduces faulty electrical connection between the feeders (3) and the heating elements (2), and thus the heat generation by the heating elements (2) can be stabilized.

9 Claims, 33 Drawing Sheets

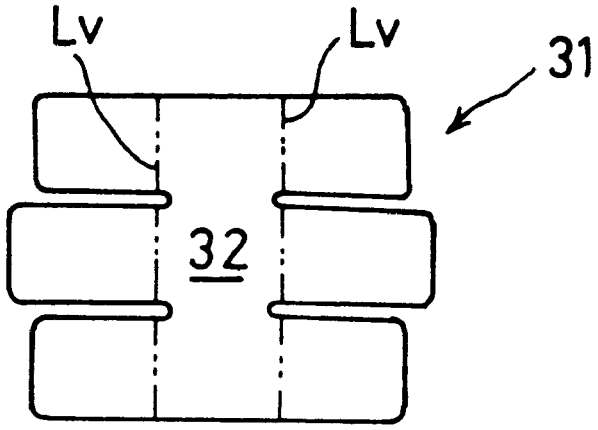
FIG.3(a)
FIG. 3(b)
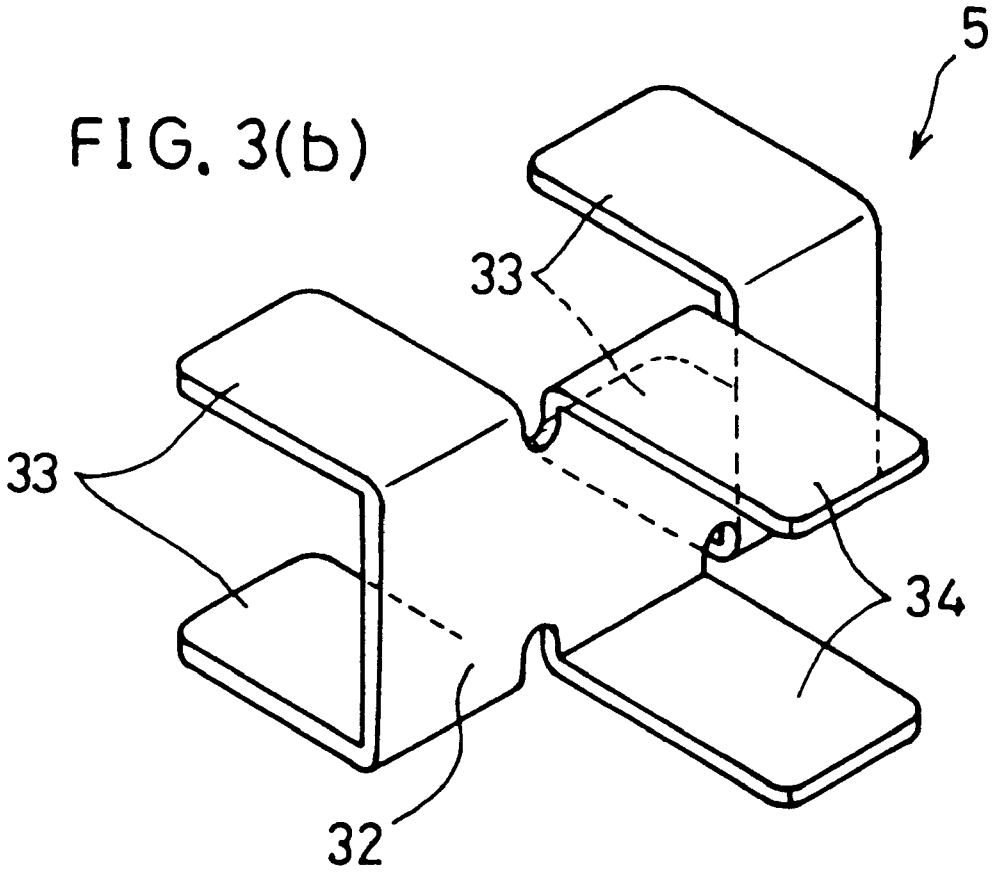

HEATER AND MANUFACTURING METHOD THEREOF

FIELD OF THE INVENTION

The present invention relates to a heater, which efficiently heats a water-residence portion of a water pipe, etc. having a curved surface, through its surface so that the water-residence portion is not damaged due to freezing of water and relates to a manufacturing method thereof.

BACKGROUND OF THE INVENTION

Conventionally, as shown in FIGS. 40(*a*) and 40(*b*), a linear heater 23 like a feeder line of TV, etc. has been used to prevent freezing of water in a water pipe at the coldest of the year in cold districts. The linear heater 23 is composed of a linear main body 22 in which a metallic resistance wire 21 such as a nichrome wire is coated with a vinyl chloride resin or the like which is an electrical insulator.

The linear heater 23 is used such that, for example, the main body 22 is wound around an outer surface of a water pipe in a spiral or is contact-bonded along the water pipe in its lengthwise direction so that the linear heater 23 closely adheres to the outer surface of the water pipe which is exposed on the ground in a house in clod districts. In order to prevent freezing, the linear heater 23 is set so that a fixed amount of electricity, for example, 6 W of electricity per 1 m of the water pipe is consumed.

In addition, a sensor, which controls on/off operations of the linear heater 23 according to a detection temperature, for example, a platinum sensor is provided to a position which is close to an exposed portion of the water pipe in the coldest place of a house, i.e., usually, the north side of the house.

When the detection temperature detected by the sensor becomes lower than 0° C., the linear heater 23 generates heat by electrifying the metallic resistance wire 21 so as to heat the outer surface of the water pipe around which the linear heater 23 was wound. As a result, the water pipe is prevented from bursting due to freezing of water at a low temperature, for example, the detection temperature is lower than 0° C.

However, the linear heater 23 shall be controlled so as to be turned on/off based upon the detection temperature by the sensor provided to a higher position such as a north side of a house where a temperature becomes the lowest.

For this reason, in the case where the linear heater 23 is installed to a water pipe along a south side of a house, for example, even when an outside air temperature on the south side of the house rises and the water temperature in the water pipe rises to such a temperature that freezing of the water does not have to be considered, the linear heater 23 is in the ON state as long as the detection temperature by the sensor is lower than 0° C. For this reason, the linear heater 23 is occasionally in the ON state all day long for a portion which does not have to be heated.

As a result, since the linear heater 23 cannot collectively heat only a specified portion where the temperature of a water pipe is low, it occasionally consumes useless electricity. Thus, the linear heater 23 has such a problem that the consumption of electricity is increased.

Therefore, in order to solve the above problem, it was considered that a heating cable disclosed in U.S. Pat. No. 4,072,848 is used as a heater for preventing freezing of water in a water pipe, etc. at the coldest of the year in cold districts.

In the above publication, as shown in FIG. 41, heating elements 52 with a chip configuration which generate heat by electrifying, and a pair of electric wires 53 made of copper which feed electricity to the heating elements 52 are sealed into a cable-like main body 51 composed of an insulator such as a thermoplastic resin.

The heating elements 52 are positive-characteristic thermistors composed of barium titanate ceramics, and they respectively have the electrode 54 for ohmic contact on both the sides of the main body 51 in the lengthwise direction.

A plurality of the heating elements 52 are placed between the electric wires 53 at fixed intervals along the lengthwise direction, and the heating elements 52 respectively have the electrodes 54 and joints 55. The joints 55 come into contact with the side surfaces of the electrodes 54 and electrically connect the electrodes 54 to the electric wires 53 by soldering along the sides of the electric wires 53.

Such a heater is used with the main body 51 coming into contact with a water-residence portion of a water pipe, etc., the heating elements 52 generate heat according to a temperature so as to be able to prevent a damage of the water-residence portion due to freezing of water at a low temperature, for example, when the temperature in the water-residence portion is lower than 0° C.

In other words, when the temperature of the heating elements 52 become, for example, not more than 5° C., they are electrified so that heat is generated. As a result, the water-residence portion, which comes into contact with the main body 51 close to the heating elements 52 which generated heat in such a manner, is heated through the main body 51 by the heating elements 52, so a damage of the water-residence portion due to freezing of water can be prevented in the surrounding of a low temperature where the water temperature in the water-residence portion is lower than 0° C.

However, the heater disclosed in the above publication is usually wound around the outer surface of a water-residence portion of a water pipe, etc. having a big curvature. In such a case where the heater is bent, a strong bending stress is applied to the main body 51, and the bending stress is applied also to the joints 55 which electrically connect the heating elements 52 to the electric wires 53.

At this time, since the electric wires 53, which are sealed into the main body 51 and made of copper, have ductility, they can be bent along the deflection of the main body 51 made of a thermoplastic resin so that the influence of the bending stress can be avoided. However, the heating elements 52 and the joints 55 are hard because they are formed by ceramics and solder. For this reason, since heating elements 52 and the joints 55 cannot be bent according to the bending stress, the bending stress is applied to them.

Accordingly, since the above-mentioned conventional heater is used for preventing water in the water-residence portion from freezing, a temperature changes greatly. Therefore, while the temperature changes frequently and thus thermal expansion and thermal contraction are repeated on the joints 55, a crack might occurs between the joints 55 and the electrodes 54, which are connected to the joints 55, or the heating elements 52 due to the strong bending stress.

As a result, the electrical connection between the heating elements 52 and the electric wires 53 via the joints 55 cannot be maintained, and the electric resistance value between the heating elements 52 and the electric wires 53 rises. Therefore, heating to a subject to be heated from the heating elements 52 becomes unstable.

The present invention is invented in view of the above problems, and it is an object of the present invention to provide a heater, which is capable of preventing water in a water-residence portion of a water pipe, etc. from freezing by suitable heating and capable of making heating in use stable, and to provide a manufacturing method of the heater.

DISCLOSURE OF THE INVENTION

In order to solve the above problems, a heater of the present invention is characterized by having:

- a cord-like main body with electrically insulation and flexibility for heating a subject to be heated;
- a plurality of heating elements which are composed of ceramics as a positive-characteristic thermistor and are provided to the main body along a lengthwise direction of the main body;
- a pair of feeders, for feeding electricity to the respective heating elements, the pair of feeders being provided to the main body; and
- a pair of retaining members with electrical conductivity which are provided to the main body so as to electrically connect the feeders and the heating element and to retain them.

In accordance with the above arrangement, since the heater generators are provided to the main body along the lengthwise direction of the cord-like main body, even if the heating elements made of hard ceramics are provided to the main body, the flexible main body can be bent along a curved surface of a water-residence portion of a water pipe, etc. as a subject to be heated. Moreover, each heating element is connected to the pair of feeders via the retaining members so that electric power is supplied from the feeders to heating elements.

Accordingly, if a Curie temperature of the heating elements as the positive-characteristic thermistors is set to about 10° C.–80° C., for example, a resistance value of the heating element in a portion whose outside air temperature is lower than normal temperature, i.e., is freezing temperature, can be low. At this time, when the heating elements are electrified, a large amount of electric currents flow through the heating elements, the heating elements generate heat so as to heat the subject to be heated quickly. As a result, the freezing of water in the water-residence portion as the subject to be heated can be prevented by heating. Moreover, the heating element in the portion which is heated to the proximity of the Curie temperature has a high resistance value, and thus the flowing electric current is decreased. Therefore, power consumption in the heating elements is suppressed.

As a result, in the above arrangement, since only a portion of a subject to be heated which requires heating can be suitably heated, a water-residual portion as a subject to be heated can be prevented from being freezed, and consumption of useless power can be suppressed.

In addition, in the above arrangement, since the retaining members retain the feeders and the heating elements, at least one part of a bending stress which is generated when the main body is bent can be absorbed by retaining of the heating elements and the feeders via the retaining members unlike conventional connection between the side of a heating element and an electric wire via solder. As a result, bad influences, which exert on the electrical connection between the heating elements and the feeders due to the bending stress, can be reduced by the retaining members.

As a result, in the above arrangement, even if the main body is bent, the connection between the feedings which are easily bent and the heating elements which are hardly bent can be maintained by the retaining members. Accordingly, the retaining members makes the above arrangement resistant to the bending, and thus the above arrangement can be used with the curvature of the main body being large.

As a result, in the above arrangement, in the case, for example, where, the main body is wound around the surface of a water-residence portion in the water pipe as a subject to be heated, the main body can be wound around the surface with the main body being firmly in contact with the surface. Moreover, in the case where the main body is firmly in contact with the surface along the lengthwise direction of the surface, the feeders can be bent together with the main body so as to be along a bent portion of the water pipe, etc. Also in this case, the connection between the heating elements and the feeders can be maintained more stably by the retaining members.

Furthermore, in the above arrangement, even if a change in a temperature becomes large due to the heating elements and the change in the temperature occurs frequently, a change in the bending stress due to the change in the temperature can be partially absorbed by the retaining members. For this reason, the electrical connection between the heating element and a pair of the feeders can be maintained.

Another heater of the present invention, is characterized in that the pair of retaining members are respectively provided with first retaining pieces for retaining the heating element and second retaining pieces for retaining the feeder so that backs of the first and second retaining pieces face each other.

In accordance with the above arrangement, when the first and second retaining pieces are provided so that their backs face each other, the retaining portion with the heating element and the retaining portions with the feeder on the retaining member can be separated from each other. As a result, the bending stress, which is generated on the second retaining piece when the main body is bent and exerts influence on the retaining portion of the first retaining piece with the heating element, can be further absorbed by the retaining members. As a result, in the above arrangement, the strength to the bending stress can be further improved.

Still another heater of the present invention is characterized in that the retaining members are respectively provided with retaining pieces for retaining the feeders with points of the retaining pieces being extended so as to retain also the heating element.

In accordance with the above arrangement, since the retaining piece for retaining the feeder is provided as that its point is extended to retain also the heating element, the retaining piece can retain both the feeder and heating element, thereby simplifying the retaining member.

Still another heater of the present invention is characterized in that the retaining members sandwich at least parts of the feeders and heating element to retain the feeders and heating element.

In accordance with the above arrangement, since the electrically conductive retaining members retain the feeders and the heating elements, the electrical connection between the retaining members, the feeders and the heating elements can be secured without solder.

Still another heater of the present invention is characterized in that the feeders are aggregate wires composed by aggregating conductive wires.

In accordance with the above arrangement, since the feeders provided to the main body are composed of aggregate wires composed by aggregating conductive wires, the flexibility of the feeders can be further improved, and a restoring force of at the time of bending can be reduced. For this reason, the main body can be bent more easily.

Still another heater of the present invention is characterized in that edges of the heating element retained by the retaining members are chamfered.

In accordance with the above arrangement, since the edges of the heating elements retained by the retaining members are chamfered, when the heating elements are installed so as to be retained by the retaining members, the installation becomes easy by the chamfering.

Still another heater of the present invention is characterized in that:

the main body is formed so as to have a cord-like shape by extrusion-molding a thermoplastic resin, protective pieces for protecting the heating element are respectively provided to the retaining members so as to be projected from end portions of the retaining members with respect to an extrusion direction of the extrusion molding along the extrusion direction.

In accordance with the above arrangement, when each heating element, which is composed of ceramics as a positive-characteristic thermistor and is connected to a pair of the feeders, is extruded by the extrusion-molding using the melted thermoplastic resin, the feeders and the heating elements are unitedly sealed into the cord-like main body made of a thermoplastic resin.

At this time, in the above arrangement, since the retaining members, which electrically connect the heating elements and the feeders, are provided, the heating elements and the feeders are retained more firmly.

In the extrusion-molding, the heating element is shifted from the central portion of the extrusion exit, and thus the front side of the heating element comes in contact with the nipple die at the extrusion exit. As a result, the heating element is occasionally damaged. If the heating element is damaged as mentioned above, exothermic efficiency of all the heating elements is deteriorated.

However, in the above arrangement, since the protective piece, which is projected in the extrusion direction with respect to the lengthwise direction of the main body from the end of the retaining member, is provided to the retaining member, when the retaining piece intervenes between the die and nipple for the extrusion molding and the heating element at the time of manufacturing the main body by the extrusion molding, the contact of the heating element with the die and nipple can be prevented. As a result, the heating element can be prevented from being damaged.

Still another heater of the present invention is characterized in that:

a plurality of heating elements composed of positive-characteristic thermistors are sealed into a cord-like main body composed of a thermoplastic resin along a lengthwise direction of the main body by extrusion molding of the main body, the heating elements are formed so that a thickness of the rear sides of the heating elements become thinner than front sides of the heating elements with respect to an extrusion direction of the extrusion molding.

In accordance with the above arrangement, since the heating element is sealed into the main body by the extrusion molding of a thermoplastic resin, the heating element is extruded from the extrusion exit of the extrusion molding together with the thermoplastic resin, the thermoplastic resin is sandwiched between the extrusion exit and the heating element. As a result, the thermoplastic resin is elastically compressed.

In the conventional manner, since a longitudinal section of the heating element in the extrusion direction is rectangular, if the thermoplastic resin is elastically compressed as mentioned above, the elastic compression is transmitted to the rear of the heating element in the extrusion direction along the surface of the heating element according to the extrusion. As a result, in the main body in which the heating elements have been extruded in the conventional manner, the thermoplastic resin is elastically expanded, and thus a convex section is occasionally formed on the main body.

However, in the above arrangement, since the rear side of the heating element is thin, a space, in which the thermoplastic resin can exist on the thin rear of the heating element, becomes larger with respect to the front of the heating element. For this reason, the backward transmission of the elastic compression of the thermoplastic resin at the time of extrusion of the heating element is relieved.

A manufacturing method of a heater is characterized by having the steps of:

providing a pair of electrodes to a heating element composed of ceramics as a positive-characteristic thermistor;

installing a pair of retaining members, which electrically connect the heating element to feeders and retain the feeders and the heating element, to the respective electrodes of the heating elements;

producing a heating unit with a long length in which the heating elements provided with their respective pairs of the retaining members are installed to a pair of the feeders via their respective retaining members along the lengthwise direction at intervals; and producing a main body by coating the heating units with a thermoplastic resin in a cord-like shape by extrusion molding of the thermoplastic resin.

In accordance with the above method, as mentioned above, it is possible to manufacture the heater which is capable of suppressing useless power consumption and of securely preventing the freezing of water in the water-residence portion as a subject to be heated.

Furthermore, in the above method, the heating unit with a long length, which is composed of a pair of feeders and the heating elements which are respectively positioned with gaps being formed between the heating elements and the feeders, can be rolled up. Moreover, the main body, which is formed by coating the heating unit like a cord by the extrusion molding of a thermoplastic resin, can be also rolled up.

Accordingly, in the above method, since it can be avoided that sizes of a die and a workshop required for manufacturing the long main body are set according to the length of the main body, the main body can be easily manufactured.

Another manufacturing method of a heater is characterized by having the steps of:

providing a pair of electrodes to a heating element composed of ceramics as a positive-characteristic thermistor;

installing a pair of retaining members, which electrically connect the heating element to feeders and retain the feeders and the heating element, to the respective electrodes of the heating element;

producing a heating unit with a long length in which the heating elements provided with their respective pairs of the retaining members are installed to a pair of the feeders via their respective retaining members along the lengthwise direction at intervals; and producing a cord-like main body by sealing the heating units among sheets made of thermoplastic resins.

In accordance with the above method, as mentioned above, it is possible to manufacture the heater which is capable of suppressing useless power consumption and of securely preventing the freezing of water in a water-residence portion as a subject to be heated.

Furthermore, in the above method, the heating unit with a long length, which is composed of a pair of feeders and the heating elements which are respectively positioned with gaps being formed between the heating elements and the feeders, can be rolled up. Moreover, the cord-like main body, which is obtained by respectively sealing the heating units between the sheets made of a thermoplastic resin, can be also rolled up.

Accordingly, in the above method, since it can be avoided that sizes of a die and a workshop required for manufacturing the long main body are set according to the length of the main body, the main body can be easily manufactured.

BRIEF DESCRIPTION OF THE DRAWINGS

FIGS. 3(*a*) and 3(*b*) show arrangement of holders of the heater; FIG. 3(*a*) is a development elevation of the holder; FIG. 3(*b*) is a perspective view of the holder:

FIG. 11(*a*) is a perspective view of the heating element; FIG. 11(*b*) is a cross sectional view taken along a line II—II of the heating element:

FIG. 13(*a*) is a front view; FIG. 13(*b*) is a plan view:

FIG. 14(*a*) is a front view; FIG. 14(*b*) is a plan view:

FIG. 15(*a*) is a front view: FIG. 15(*b*) is a plan view:

FIG. 18(*b*) is a perspective view:

FIGS. 19(*a*), 19(*b*) and 19(*c*) are front views:

FIG. 20(*a*) is a perspective view; FIG. 20(*b*) is a perspective view when the holders are installed to the heating elements:

FIG. 29(*a*) is a development elevation of the holder; FIG. 29(*b*) is a perspective view of the holder:

FIGS. 32(*a*) and 32(*b*) are perspective views:

FIG. 38(*a*) is a development elevation of the holder; FIG. 38(*b*) is a perspective view of the holder:

FIGS. 39(*a*), 39(*b*), 39(*c*) and 39(*d*) are perspective views:

FIG. 40(*a*) is a plan view; FIG. 40(*b*) is a side view:

THE MOST PREFERRED EMBODIMENTS OF THE INVENTION

Embodiment 1

The following describes one embodiment of the present invention as embodiment 1 on reference to FIGS. 1 through 24.

Figure 1:
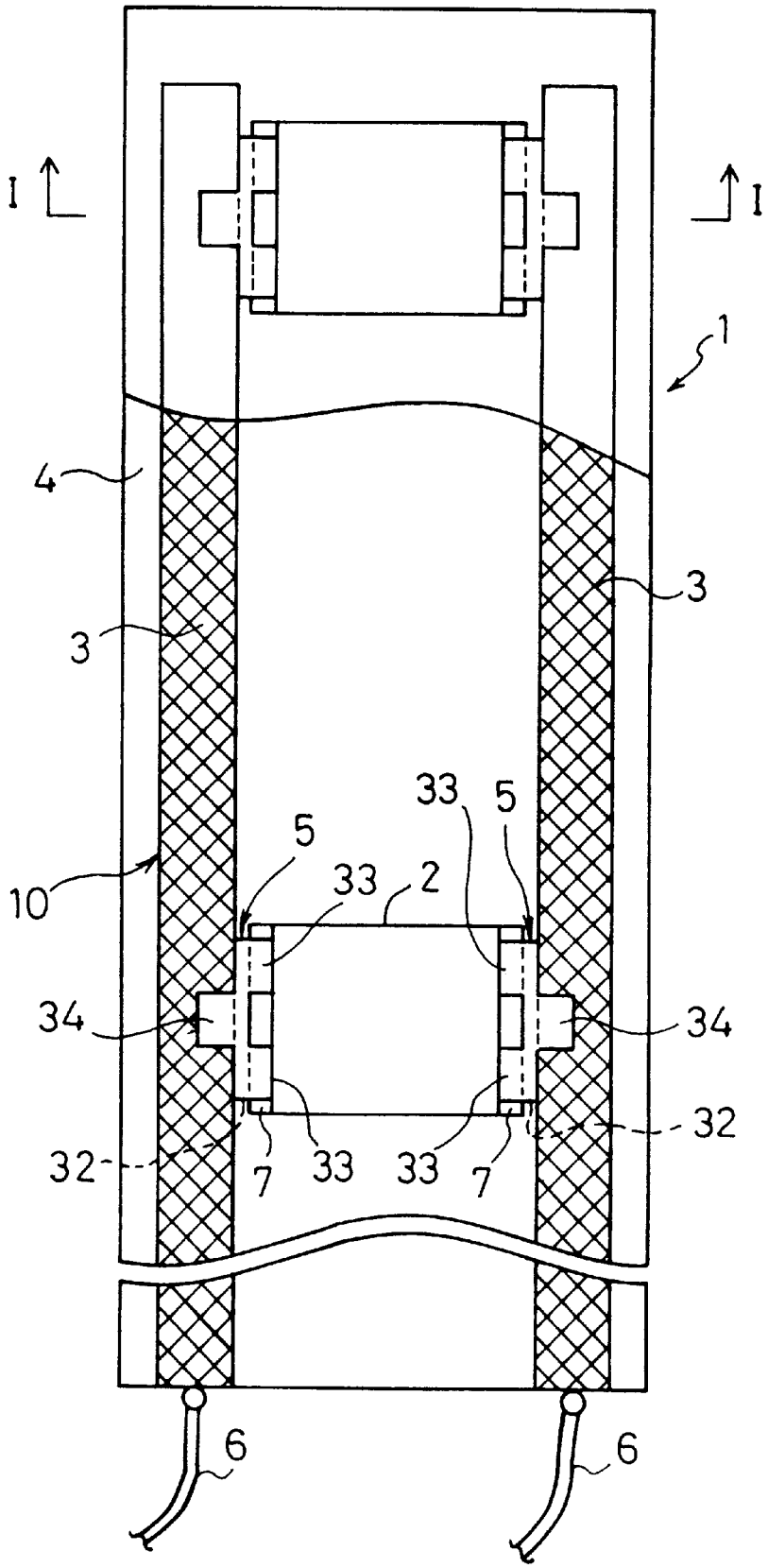
FIG. 1 is a broken sectional view which shows a main portion of a heater according to one embodiment of the present invention.
Figure 2:
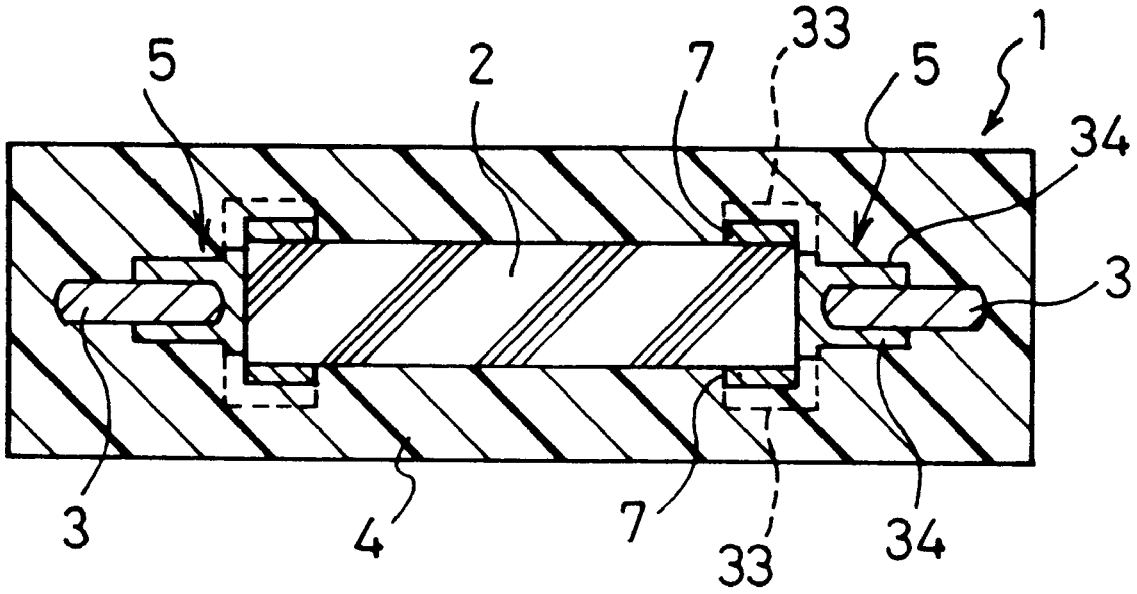
FIG. 2 is a cross sectional view taken along line I—I of the heater in FIG. 1.

As shown in FIGS. 1 and 2, a heater is provided with a heater main body (main body) 1 which is formed by extrusion-molding a thermoplastic resin such as a vinyl chloride resin so as to become like a long cord having, for example, a thickness of 5.1 mm and a width of 16.6 mm. The heater main body 1 is easily bent along the surface of a subject to be heated, which has a curved surface, such as a water pipe, etc. with a water-residence portion, so as to heat the subject to be heated by the contact and heat radiation. The extrusion molding for forming the above-mentioned cord-like heater is also called as draw molding.

The cord-like shape is a shape of an electric line having a circular or elliptic cross section which is vertical to a lengthwise direction, or a linear shape having a rectangular cross section. It is desirable that the heater main body 1 has a plane section in order to improve a contact state of the heater main body 1 to the subject to be heated, and thus a linear shape is particularly preferable. Hereinafter, the description will be given in the case of the heater main body 1 having a linear shape.

A plurality of heating elements 2 made of ceramics as a rectangular board-like positive-characteristic thermistor are sealed into the linear heater main body 1 at predetermined intervals so that one end surface of the heating element 2 is along the lengthwise direction of the heater main body 1.

If the heater main body 1 is formed with the above dimensions, the heating elements 2 are formed with dimensions such as a length of 6.0 mm, a width of 8.0 mm and a thickness of 1.6 mm. At this time, when an AC voltage of 100V as a commercial voltage is applied at an outside air temperature of −20° C., the heating elements 2 are set so as to consume total electricity of about 18 W, for example, per meter. The shape of the heating element 2 can be a disk-like shape.

The heating elements 2 are provided to the central portion of the heater main body 1 so that both sides of the heating elements 2 in the thickness-wise direction are approximately parallel with both sides of the heater main body 1 in the thickness-wise direction, and the respective thicknesses of the heater main body 1 on the heating elements 2 in the thickness-wise direction of the heater main body 1 become approximately uniform.

Linear electrodes 7 are respectively formed on both end surfaces of the heating element 2 in the thickness-wise direction and on both the sides of the heater main body 1 in the lengthwise direction so as to be along the lengthwise direction of the heater main body 1. The electrodes 7 are obtained by heating the heating element 2 at a temperature of 560° C. for 5 minutes after the application of silver paste (made by Degussa Co., Ltd.) for forming an ohmic contact electrode.

By providing the electrodes 7, when electricity is supplied to the heating element 2, between the electrodes which respectively face each other on both sides of the heating element 2 in the thickness-wise direction, heat is generated first on both the surfaces of the heating element 2 and in their vicinities due to the electrification. Then, as the temperature rises, the insides of the heating elements 2 are successively heated.

As a result, when the electrodes 7 are position in the above manner, both the end surfaces of the heating element 2 in the thickness-wise direction are first heated. For this reason, both the surfaces of the heater main body 1 in the thickness-wise direction, which are close to the end surfaces, are quickly heated. Therefore, in the above arrangement, the provision of the electrodes 7 can improve heating efficiency using the heating elements 2.

A pair of feeders 3 for supplying electricity to the heating elements 2 are sealed into the heater main body 1 along the lengthwise direction of the heater main body 1 so as to be parallel with each other. As a result, the heating elements 2 are connected to a pair of the feeders 3 so that the heating elements 2 are positioned at predetermined intervals and are electrically parallel with each other between the feeders 3. As the feeders 3, a solid wire or a aggregate wire made of copper, etc. having conductivity can be used, particularly, a braided wire of copper wires is preferable because it can be easily bent.

Pair of holders (retaining members) 5 are provided into the heater main body 1 so as to retain the heating elements 2 and the feeders 3 placed along both the sides of the heating elements 2. The holders 5 electrically connect the electrodes 7, which were respectively formed on both the sides of the heating elements 2 with respect to the lengthwise direction of the heater main body 1, to the feeders 3. Moreover, the holders 5 have conductivity and flexibility.

In accordance with the arrangement of embodiment 1, since the heating elements 2 are provided to the heater main body 1 along the lengthwise direction of the cord-like heater main body 1, even if the heating elements 2 made of hard ceramics are provided to the heater main body 1, the heater main body 1 having flexibility can be bent so as to be along the curved surface of a water-residence portion of a water pipe, etc. as a subject to be heated. Moreover, the heating elements 2 are connected to a pair of the feeders 3 via the holders 5 having conductivity so that electricity is supplied to the heating elements 2 from the feeders 3.

Accordingly, if a Curie temperature of the heating elements 2 which is positive-characteristic thermistors is set to about 10° C. through 80° C., for example, the resistance value of the heating elements 2, which is in a part whose outside air temperature is lower than the ordinary temperature, i.e., becomes the ice point, can be set lower.

At this time, when electricity is supplied to the heating elements 2, a large amount of electric currents flow in the heating elements 2, and the heating elements 2 generate heat so as to be able to heat the subject to be heated quickly. As a result, the heating can prevent water in the water-residence portion as the subject to be heated from freezing. Moreover, the heating element 2 in a part whose temperature rises to the vicinity of the Curie temperature obtains a high resistance value, and thus the flowing current is decreased. Therefore, the power consumption of the heating element 2 is suppressed.

As a result, in the above arrangement, since only a portion of a subject to be heated which requires heating can be suitably heated, water in the water-residence portion of the subject to be heated can be prevented from freezing, and also useless power consumption can be suppressed.

Further, in the above arrangement, since the holders 5 having flexibility retain a pair of the feeders 3 and the heating elements 2, at least parts of a bending stress, which is generated when the heater main body 1 is bent, can be absorbed by the retention of the feeders 3 and the heating elements 2 via the holders 5 unlike a conventional linear connection by soldering the side of a heating element onto an electric wire. As a result, bad influences of the bending stress which exert on the electrical connection between the heating elements 2 and the feeders 3, can be decreased by the holders 5.

As a result, in the above arrangement, even if the heater main body 1 is bent, the connection between the feeders 3 which are easily bent and the heating elements 2 which are hardly bent can be maintained by the holders 5. Therefore, due to the provision of the holders 5 the above arrangement is proof against bending, and thus the heater main body 1 can be used with its curvature being large.

As a result, in the above arrangement, if the heater main body 1 is wound around the surface of the water pipe as a water-residence portion, which is a subject to be heated, in a spiral, for example, the heater main body 1 can be wound around the surface with the heater main body 1 being contact with the surface. Moreover, in the above arrangement, if the heater main body 1 is brought into contact with the surface of the water pipe, etc. in the lengthwise direction, the feeders 3 can be bent along the bent portion of the water pipe, etc., together with the heater main body 1. Also in such a case, the connection between the heating elements 2 and the feeders 3 can be maintained by the holders 5 more stably.

Furthermore, in the above arrangement, even if the temperature changes greatly and frequently due to the heating elements 2, a change in the bending stress due to the temperature change can be also absorbed partially by the holders 5. For this reason, the electrical connection between the heating elements 2 and pairs of the feeders can be maintained.

In addition, each holder 5 is provided with two pairs of heating element retaining pieces (first retaining pieces) 33 and a pair of feeder retaining pieces (second retaining pieces) 34. Two pairs of the heating element retaining pieces 33 face each other, and electrically connect the electrodes 7 and the holders 5 by sandwiching them from both the sides of the heating elements 2 in the thickness-wise direction. A pair of feeder retaining pieces 34 face each other and sandwich the feeders 3 along a circumferential direction of the feeders 3.

In addition, electricity supply cords 6 which connect the feeders 3 and an external power source are connected to one terminal of the feeders 3 respectively with solder, and electric power is supplied from the electricity supply cords 6 to the heating elements 2 via the feeders 3 and the holders 5.

The heating elements 2, the feeders 3 and the holders 5 form a long heating unit 10. When the heating unit 10 is sealed into the heater main body 1 which was formed by extrusion-molding the covering member 4 made of the thermoplastic resin, the heating units 10 can be supported in the heater main body 1 and are insulated from the outside.

Since the heater main body 1 can be easily bent, it can be along the curved surface of the water-residence portion of a water pipe, etc. In this state, when electricity is supplied to the heating elements, the heating elements 2 generate heat so that the heat is transmitted to the surface of the heater main body 1.

At this time, since the heat is transmitted also via the feeders 3 having stronger heat conductivity than the covering member 4, the surface of the heater main body 1 can be heated more uniformly. As a result, the above arrangement makes it possible to heat the water-residence portion quickly by the heater main body 1.

Further, in the above arrangement, even in the bending state, the electrical connection between the heating elements 2 and the feeders 3 can be securely maintained by the holders 5, and the water-residence portion can be heated stably.

In other words, in accordance with the above arrangement, the heating elements 2 are connected to the feeders 3 via the feeder retaining pieces 34 of the holders 5, and the feeder retaining pieces 34 are formed along the circumferential direction of the feeders 3 so as to sandwich the feeders 3. For this reason, compared with the conventional linear connection between the whole side surface of a heating element and a feeder with solder, a length of the contact between the feeder 3 and the feeder retaining piece 34 in the lengthwise direction of the feeders 3 can be made smaller, thereby making it possible to obtain the contact which is closer to point contact.

For this reason, in the above arrangement, if the heater main body 1 is bend so as to be along a subject to be heated having curvature, the bad influences, which exert on the connection between the feeders 3 and the feeder retaining pieces 34 due to the bending stress to the feeder retaining pieces 34 which is generated when the feeders 3 are bent together with the heater main body 1, can be reduced more than the conventional manner.

This can be explained from the aforementioned point contact between the feeders 3 and the feeder retaining pieces 34 and the electrical contact between the feeders 3 and the feeder retaining pieces 34 which is obtained by caulking of the feeder retaining pieces 34.

Further, since the holders 5 have flexibility, they can be bent more easily than solder and the heating elements 2. Thereby, the bad influences, which exert on the connection between the feeders 3 and the feeder retaining pieces 34 due to the bending stress, can be further reduced.

As a result, in the above arrangement, in the case where the heater main body 1 is bent, even if the temperature of the holders 5 becomes higher and frequently changes due to repetition of heating by the heating elements 2, the electrical connection between the feeders 3 which are easily bent and the heating elements 2 which are hardly bent can be maintained.

As a result, in the above arrangement, even in environment that the temperature greatly changes, the feeder retaining pieces 34 of the holders 5 can maintain the electrical connection when the heater main body 1 is bent. Therefore, the curvature of the heater main body 1 can be made larger.

Accordingly, in the above arrangement, in the case where, for example, the heater main body 1 is wound around the outside surface of the water pipe as the water-residence portion, which is a subject to be heated, in a spiral, the heater main body 1 can be contact-wound around the outer circumference of the water pipe. Moreover, in the case where the heater main body 1 is brought into contact with the water pipe along the lengthwise direction of the water pipe, even if the feeders 3 are bent together with heater main body 1 along the bent portion of the water pipe, the connection between the heating elements 2 and the feeders 3 can be maintained securely.

The following describes the manufacturing method of the above heater. First, the description will be given as to a manufacturing method of the holders 5. As shown in FIG. 3(*a*), a board material 31, which has a slit groove and is symmetrical with respect to long sides of a rectangular bottom section 32, is successively bent along a bending line Lv by stamping a metal plate with a press. By this simple step, as shown in FIG. 3(*b*), the holders 5 are manufactured so as to respectively have the bottom sections 32, the heating element retaining pieces 33 and the feeder retaining pieces 34. As a material of the holder 5, a metal plate such as copper, which has electric conductivity and can be bent flexibly, is suitable.

Figure 4:
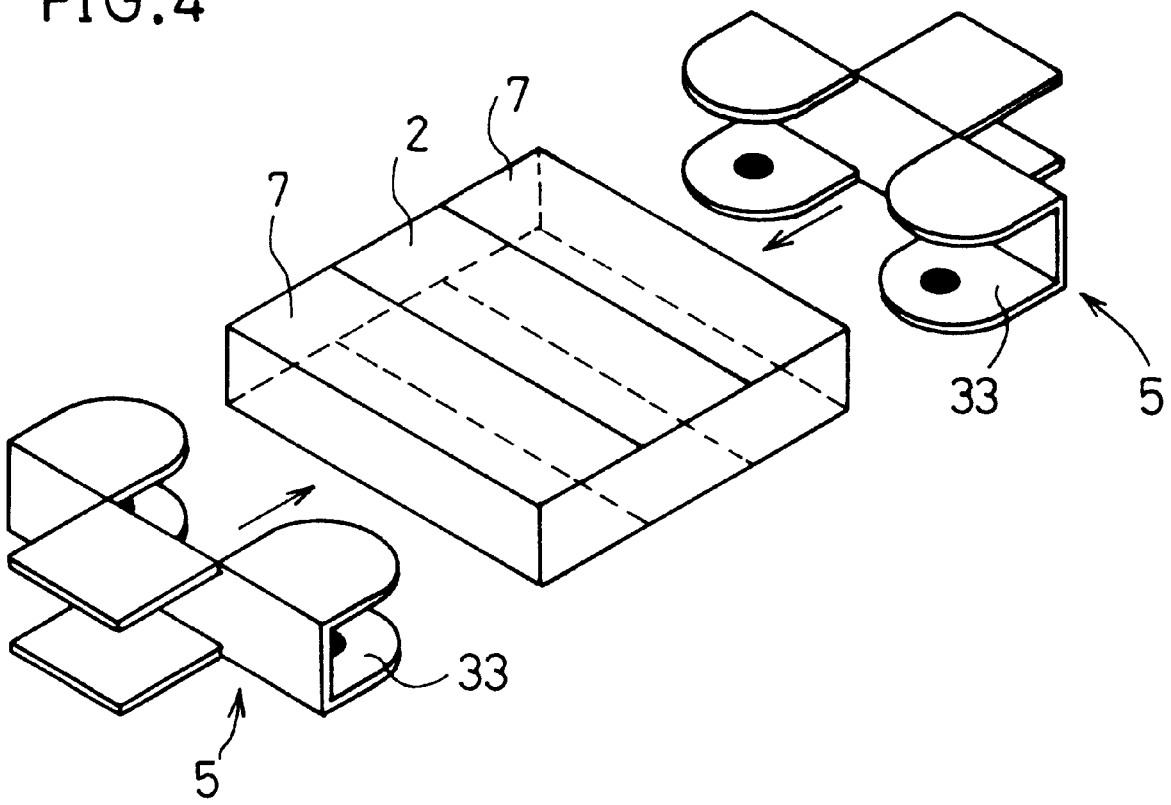
FIG. 4 shows one step of the manufacturing method of the heater, and is a perspective view before installation of the holders to heating elements.
Figure 5:
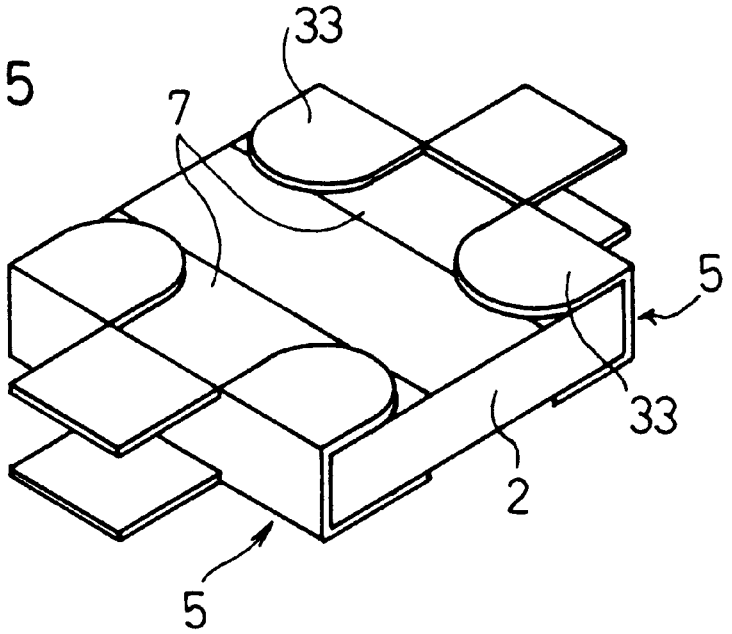
FIG. 5 shows another one step of the manufacturing method of the heater and is a perspective view after installation of the holders to the heating elements.

Then, the heating unit 10 is manufactured by using the holders 5. First, as shown in FIG. 4, both end surfaces of the heating element 2 in the thickness-wise direction, where electrodes 7 are formed respectively, are sandwiched by the heating element retaining pieces 33 so that the heating element retaining pieces 33 come in contact with the electrodes 7. The heating element retaining pieces 33 which sandwich the heating element 2 are caulked in a direction where the heating element retaining pieces 33 are brought close to each other, and as shown in FIG. 5, the holders 5 are installed to the heating element 2. At this time, cream solder or the like may be previously applied to inner surfaces of the heating element retaining pieces 33 which are face each other if necessary.

Figure 6:
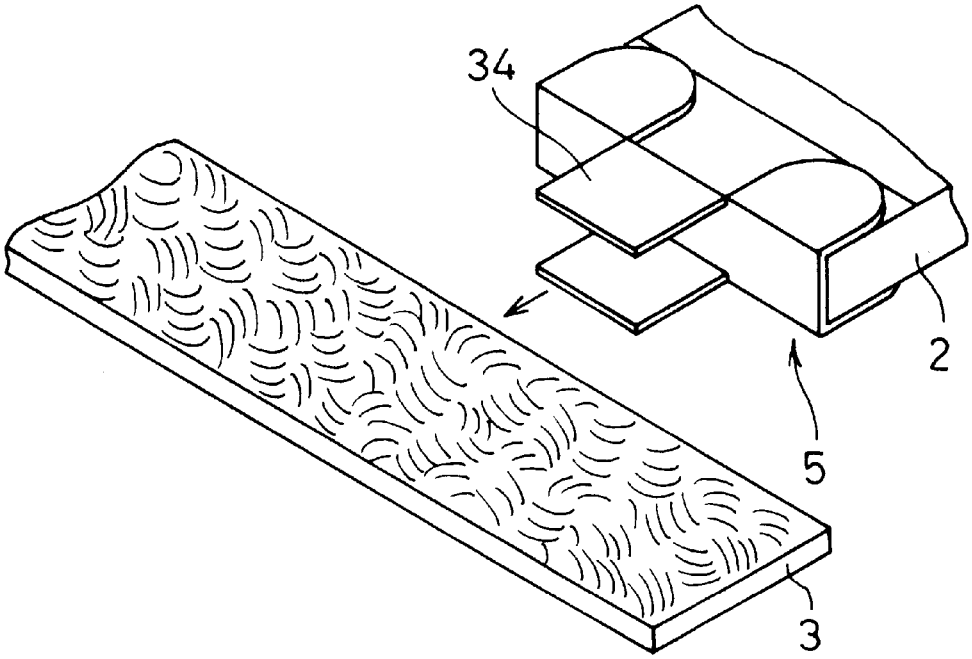
FIG. 6 shows still another step of the manufacturing method of the heater and is a perspective view just before installation of feeders to the holders.
Figure 7:
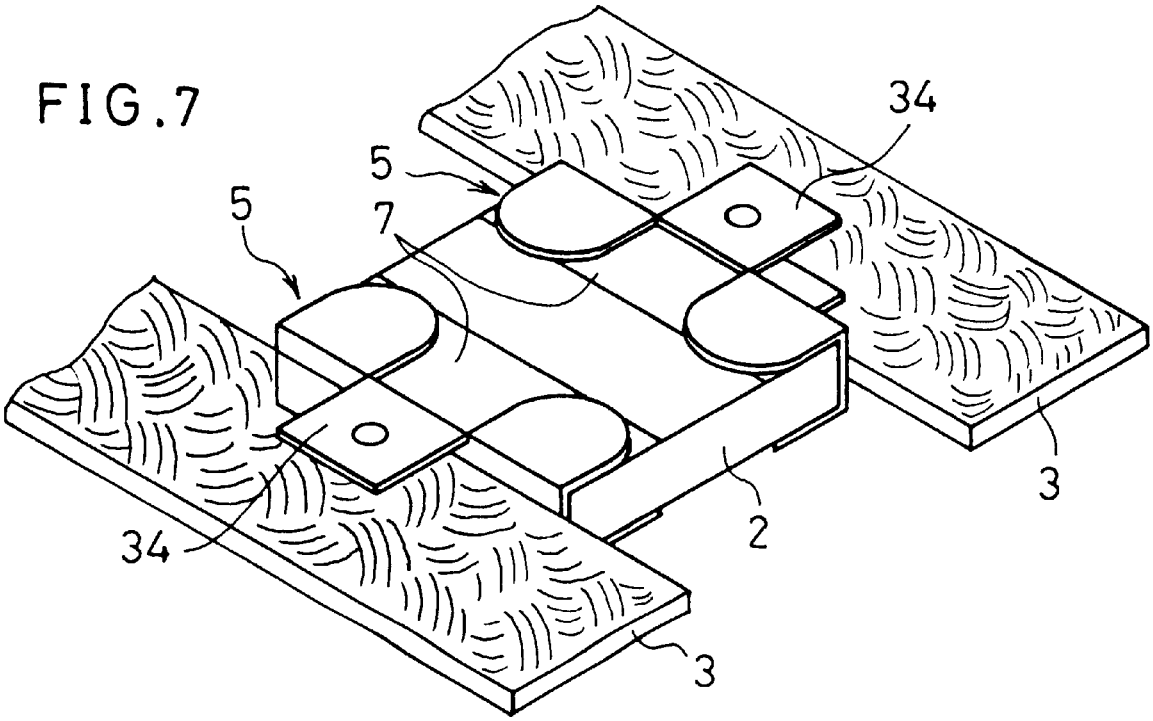
FIG. 7 shows still another one step of the manufacturing method of the heater and is a perspective view after installation of feeders to the holders.

Thereafter, as shown in FIG. 6, the feeders 3 are respectively put through the feeder retaining pieces 34 which become pieces protruded towards the outside of the heating element 2, and the feeder retaining pieces 34 are caulked in a direction where they are brought close to each other. As a result, as shown in FIG. 7, the feeder retaining pieces 34 sandwich and retain the feeders 3 with the feeder retaining pieces 34 being along a circumferential direction of the feeders 3. At this time, the feeder retaining pieces 34 may be a spot-welded to the feeders 3 if necessary.

Figure 8:
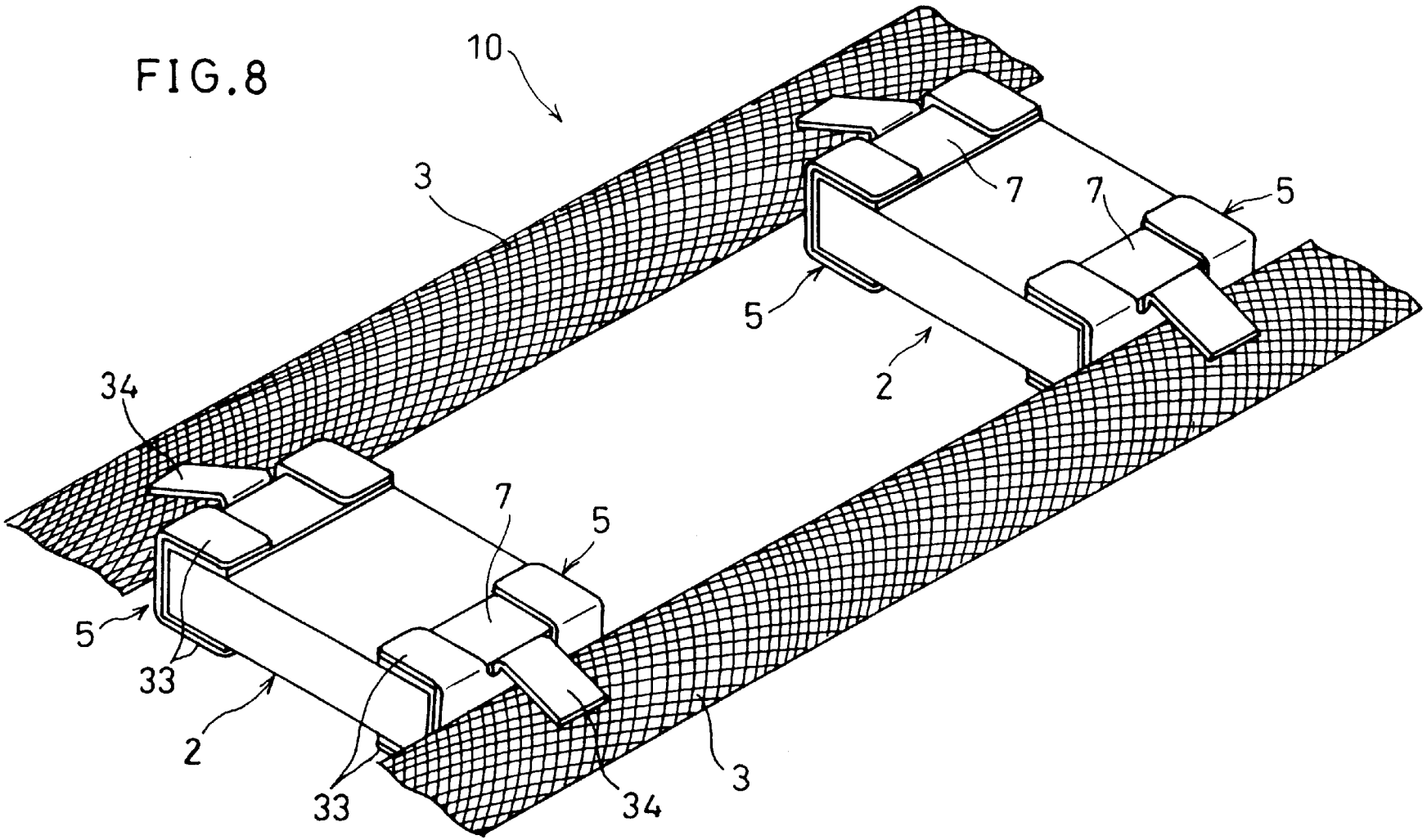
FIG. 8 shows still another one step of the manufacturing method of the heater and is a perspective view which shows a main portion of a heat generating unit in which the heating elements are installed to the feeders via the holders.
Figure 9:
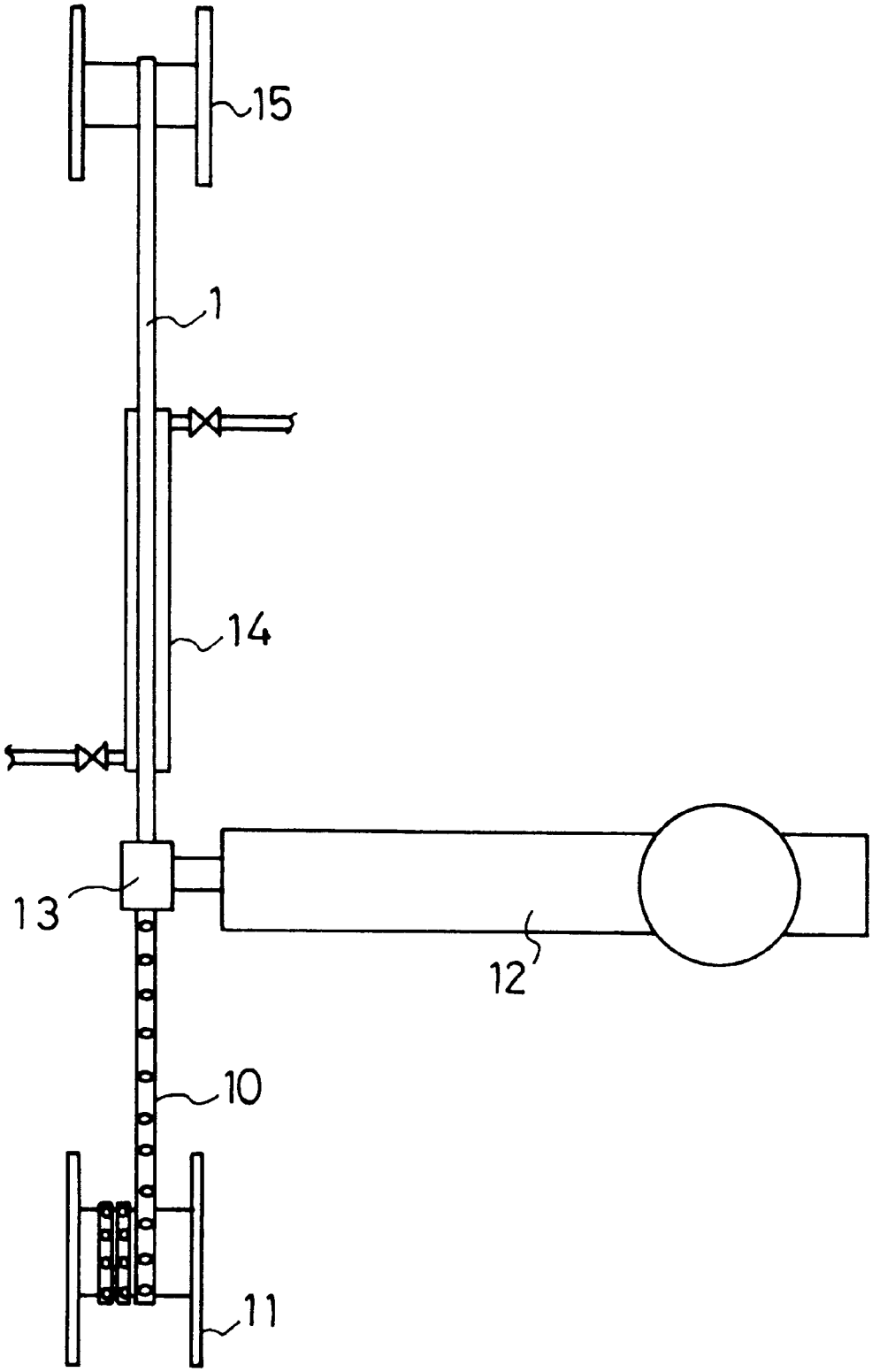
FIG. 9 shows still another one step of the manufacturing method of the heater and is an arrangement view which shows a step of sealing the heat generating unit into the heater main body by an extruder.

When the feeders 3 are respectively put through the feeder retaining pieces 34 of the holders 5, and the feeder retaining pieces 34 are respectively retained and fixed to the feeders 3, as shown in FIG. 8, the long heating unit 10, in which the heating elements 2 are respectively sandwiched between the feeders 3 via the holders 5, is manufactured. As shown in FIG. 9, the heating unit 10 is rolled up by a roll-up drum 11.

Figure 10:
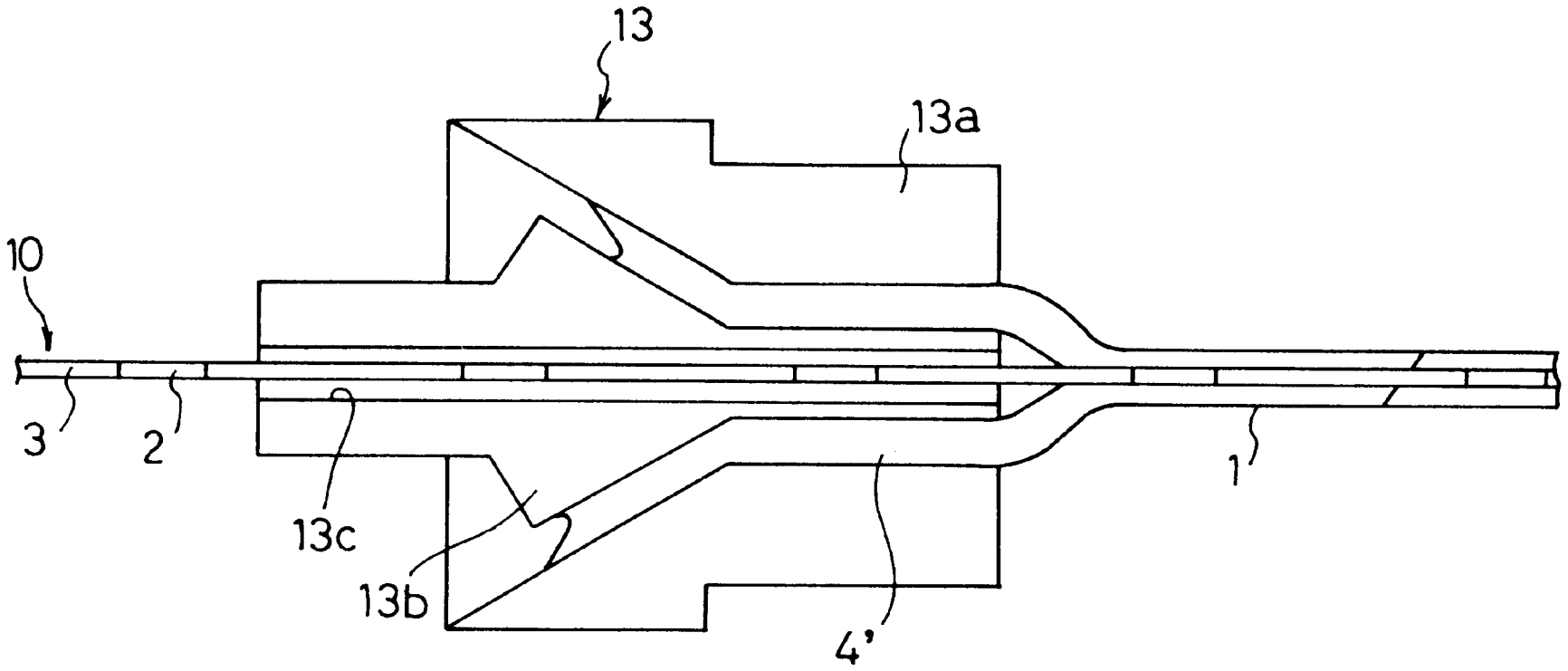
FIG. 10 is a schematic cross sectional view of a crosshead of the extruder.

The heater having the aforementioned heating units 10 is manufactured by the method of the extrusion-molding a thermoplastic resin. First, as shown in FIG. 10, when a thermoplastic resin 4' such as an electrically conductive and flexible vinyl chloride resin is extruded by a predetermined pressure from a crosshead 13 of an extruder 12 so that a linear formation is manufactured by the extrusion molding, the heating units 10 are respectively sandwiched between the extruded thermoplastic resins 4' so as to be sealed into the formation along the lengthwise direction of the formation.

At this time, the thermoplastic resins 4' are pushed out between dies 13*a* and nipples 13*b* of the crosshead 13, whereas when the heating unit 10 are respectively passes through the nipples 13*b*, the thermoplastic resins 4' are pushed out from the heating unit 10 so as to direct to both the end surfaces of the heating element 2 in the thickness-wise direction.

At this time, the thermoplastic resins 4', which were absorbed through a through hole 13*c* through which the heating unit 10 in the nipples 13*b* passes through and were pushed out tubularly from a space between the dies 13*a* and the nipples 13*b*, and a space surrounded by points of the nipples 13*b* are at reduced pressure. As a result, the thermoplastic resins 4' are stuck to the heating unit 10 quickly and are united each other.

In such a manner, after the thermoplastic resins 4' sandwiched the heating units 10 and they are united, as shown in FIG. 9, the united thermoplastic resin 4' is cooled in a water cooling tank 14, and the linear heater main body 1 having the heating unit 10 is formed. The heater main body 1 is rolled up by the roll-up drum 15.

In accordance with the above method, the manufacturing of the heating unit 10 can be easily automated, and the heating unit 10 can be continuously sealed into the heater main body 1 by the extrusion-molding the thermoplastic resin.

Furthermore, since the heating unit 10 and the heater main body 1 can be rolled up, when the heater main body 1 sealed into which the heating unit 10 was sealed without a particular limitation of the length is manufactured, a die according to the length of the heater main body 1 does not have to be used unlike the case of compressed forming, thereby saving space. As a result, this method makes it easy to manufacture the heater main body 1.

In addition, in accordance with the above method, the heating elements 2 are connected to the feeders 3 by the contact between the heating elements 2 and the heating element retaining pieces 33 of the holders 5 and the contact between the feeder retaining pieces 34 of the holders 5 and the feeders 3. Moreover, the heating unit 10 is sealed into the heater main body 1 while the heating element retaining pieces 33 are being pressed against the heating elements 2 and the feeder retaining pieces 34 are being pressed against feeders 3 by contraction of the thermoplastic resins due to cooling, which were expanded due to heating at the time of extrusion molding.

Accordingly, in accordance with the above method, the connection between the heating elements 2 and the heating element retaining pieces 33 of the holders 5 and the connection between the feeder retaining pieces 34 of the holders 5 and the feeders 3 can be maintained in the heater main body 1 by a contraction force at the time of cooling the thermoplastic resins even in the case where the heater main body 1 is bent. For this reason, the conventional bonding by solder for the connection between heating elements and feeders can be omitted.

In addition, in accordance with the above method, after the heating elements 2 are fitted between the heating element retaining pieces 33 of the holders 5 and the feeders 3 are fitted between the feeder retaining pieces 34 of the holders 5, by caulking the retaining pieces 33 and 34, the heating elements 2 are connected to the feeders 3 via the holders 5 so that the heating unit 10 can be manufactured.

As a result, in accordance with the above method, the fitting and caulking processes which are easily automated can be used and the soldering process can be omitted. For this reason, the manufacturing of the heating unit 10 in which the heating elements 2 are connected to the feeders 3 can be easily automated.

Further, the heating unit 10, which is manufactured with the process being omitted by automation, is successively sealed into a linear formation composed of a thermoplastic resin so that the heater main body 1 can be manufactured. For this reason, the heater main body 1 into which the heating unit 10 was sealed can be easily manufactured without a limitation in the length.

Accordingly, in the above method, since the continuous manufacturing of the long heater main body 1 can be automated and simplified, it is possible to reduce manufacturing costs of the heater main body 1.

Figure 11A:
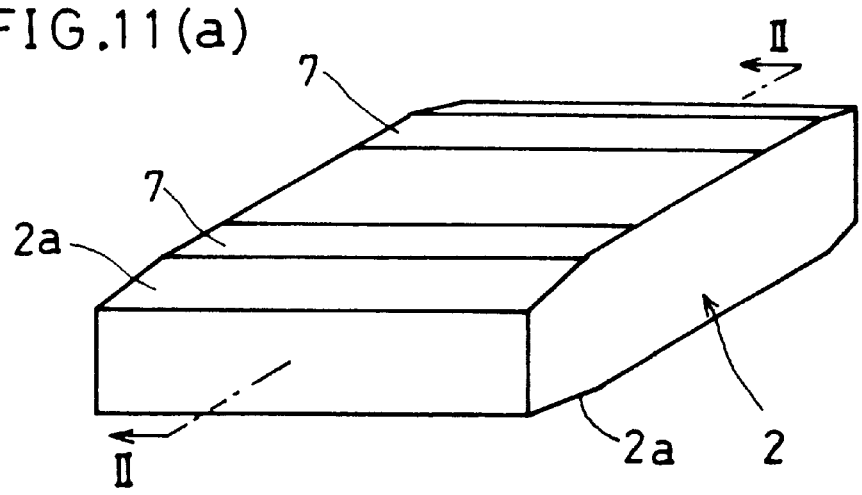
FIGS. 11(*a*) and 11(*b*) show a chamfered portion of the heating element.
Figure 11B:
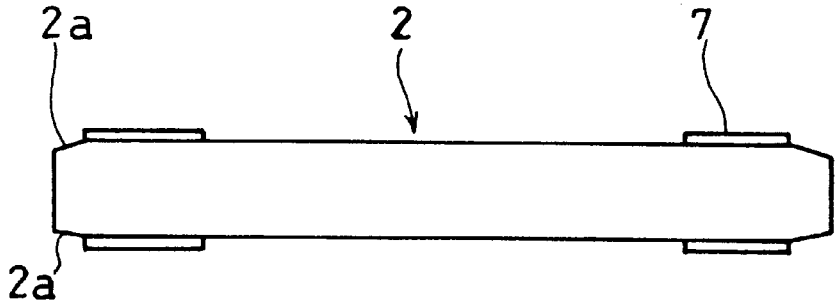

As shown in FIG. 11, in the arrangement of embodiment 1, chamfered portions 2*a* may be formed by previously chamfering edges of the heating elements 2 which face the heating element retaining pieces 33. As a result, since the heating elements 2 composed of ceramics are hard and fragile, when the heating elements 2 are inserted between the heating element retaining pieces 33 so as to be sandwiched by the heating element retaining pieces 33, the chamfered portions 2*a* can prevent a damage and a crack of square portions to be the edges of the heating elements 2.

As a result, in the arrangement with the chamfered portions, since bad influences due to the damage, etc., which exert on the electrodes 7, of the heating element 2 located in the vicinities of the chamfered portions 2*a* can be avoided, the heating of the heating elements 2 sealed into the heater main body 1 can be made more stable, and thus the heater main body 1 which securely generate heat can be manufactured more stably.

Figure 12:
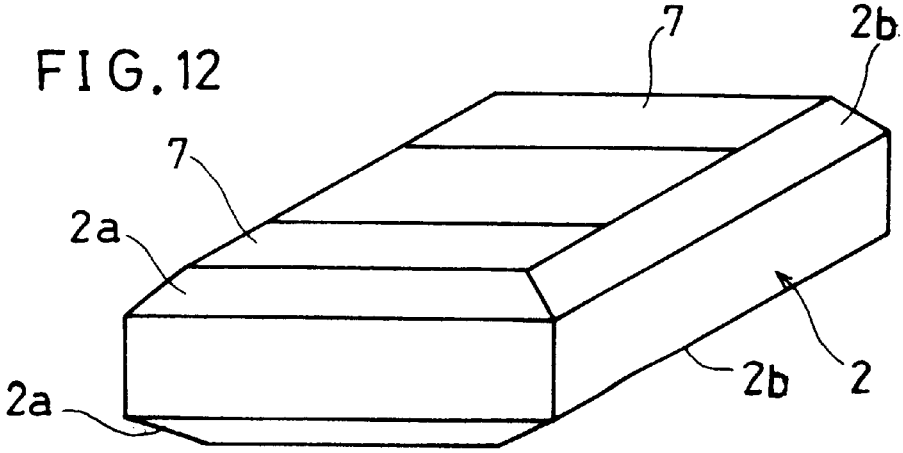
FIG. 12 is a perspective view of the heating element which shows another example of the chamfered portion of the heating element.

Further, in the arrangement of embodiment 1, as shown in FIG. 12, chamfered portions 2*b* may be formed by chamfering edges on both the end surfaces of the heating element 2 in the extrusion direction. As a result, the chamfered portions 2*b* can avoid a damage to the heating element 2 which occurs when the heating element 2 comes in contact with the dies 13*a* and the nipples 13*b* at the time of the extrusion molding. For this reason, the heating of the heating elements 2 sealed into the heater main body 1 can be made more stable, and thus the heater main body 1 which securely generates heat can be manufactured more stably.

Next, as to materials of the heating element 2, the heating element 2 is composed of a material made of ceramics semiconductor having PTC (Positive Temperature Coefficient) characteristic which is a characteristic of positive-characteristic thermistors, i.e., ceramics semiconductor mainly containing, for example, barium titanate, etc. Such ceramics semiconductor is a thermal element having a characteristic such that its resistance is low in a range of room temperature to a Curie temperature Tc (temperature at which resistance suddenly changes), but if the temperature exceeds the Curie temperature Tc, a resistance value is suddenly increased.

Because of this characteristic, when a voltage is applied to the heating elements 2 at a low temperature which is lower than the Curie temperature Tc, a large amount of electric currents flow because the resistance value is low due to the low temperature. As a result, the temperature rises suddenly. Meanwhile, when the temperature exceeds the Curie temperature Tc, the resistance value is rapidly increased, and the value of flowing electric currents is lowered, and thus a calorific value is decreased. As a result, the temperature does not rise over a specific temperature, and thus the temperature is kept stable. Namely, the heating element 2 has a temperature self-control function.

The Curie temperature Tc of heating element 2 can be set arbitrarily according to a composition of a material in a range of about −15 to 250° C. The Curie temperature Tc of the heating element 2 may be set according to a thickness of the heater main body 1, intervals between the heating elements 2 and a calorific value of a subject to be heated, but in the present embodiment 1, the temperature is set to 40° C. to 50° C.

As mentioned above, in the heater main body 1, the resistance values of the heating elements 2 positioned at predetermined intervals rise (drop) rapidly according to outside air temperature. Namely, in a portion where the outside air temperature around the water pipe is lower than a normal temperature, for example, lower than the freezing temperature, the resistance value of the heating element located in this portion becomes smaller, and a current easily flows there. As a result, a water-residence portion of a subject to be heated such as a water pipe, etc. is heated so that freezing of water in the water-residence portion is prevented.

Meanwhile, in a water-residence portion where the outside air temperature is high, the resistance value of the heating element 2 in this portion becomes larger, and a flowing current is decreased. As a result, the calorific value is decreased, and thus power consumption of the heating elements 2 can be reduced with a predetermined temperature being kept.

In such a manner, since only the portion which requires heating can be heated, the total power consumption of the heater main body 1 can be reduced lower than the conventional one, and thus an electricity bill, which is the cost of maintenance for preventing freezing of water in the water-residence portion of a water pipe, etc., can be suppressed lower than the conventional one.

As a result, in the above arrangement, heat can be applied to only a necessary portion of a subject to be heated such as a water-residence portion of a water pipe, etc. and even when the heater main body 1 is bent, a defective supply of electricity to the heating element 2 whose temperature greatly changes can be avoided. For this reason, since useless power consumption can be suppressed, and the heating of the heating element 2 can be made stable, freezing of water in a water-residence portion as a subject to be heated can be prevented more securely.

Figure 13A:
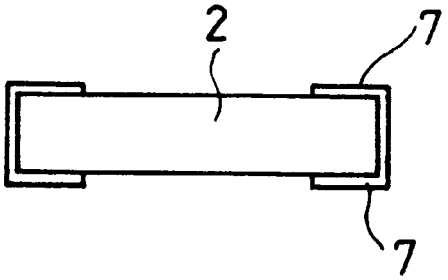
FIGS. 13(*a*) and 13(*b*) are explanatory drawings which show other examples of an electrode forming position of the heating element in the heater.
Figure 13B:
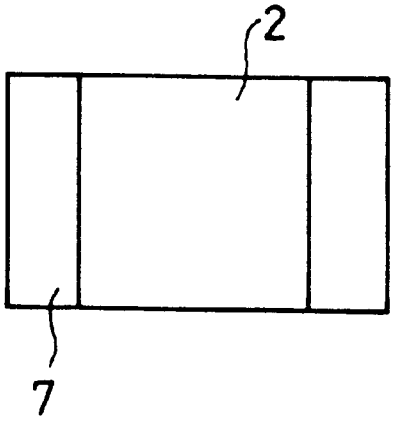

The embodiment 1 explains an example that the electrodes 7 are respectively provided to both the end surfaces of the heating element 2 in the thickness-wise direction, but the present invention is not limited to this, so as shown in FIG. 13, for example, the electrodes 7 may be respectively formed on both the sides of the heating element 2 with a U-shaped section being formed so as to come in contact with the heating element retaining pieces 33 and the bottom sections 32 of the holders 5. As a result, since contact areas between the holders 5 and the heating element 2 can be increased, the electrical connection therebetween can be made secure.

Figure 14A:
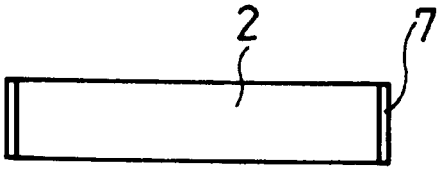
FIGS. 14(*a*) and 14(*b*) are explanatory drawings which show still other examples of the electrode forming position of the heating element in the heater.
Figure 14B:
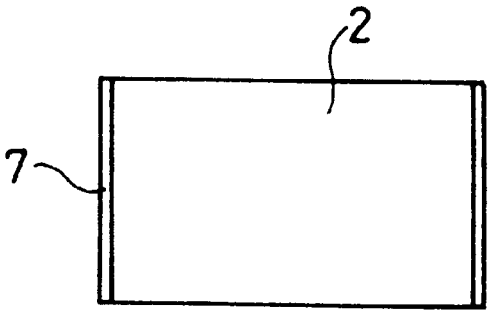

In addition, as shown in FIG. 14, the electrodes 7 may be formed on both the side surfaces of the heating element 2 in the lengthwise direction so as to surround and come in contact with the bottom sections 32 of the holders 5. Since an effective electrode area can be increased depending on the forming positions of the electrodes 7, a lower resistance value, which is obtained when the heating element 2 has a lower temperature, can be suppressed. As a result, an applied voltage can be lower, and use of silver paste for the electrodes 7 can be suppressed, thereby decreasing manufacturing costs.

Figure 15A:
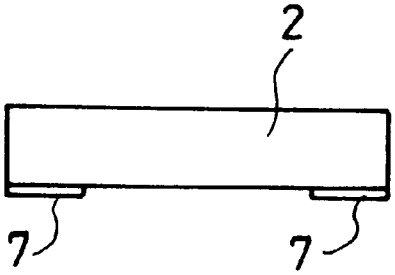
FIGS. 15(*a*) and 15(*b*) are explanatory drawings which show still other examples of the electrode forming position of the heating element in the heater.
Figure 15B:
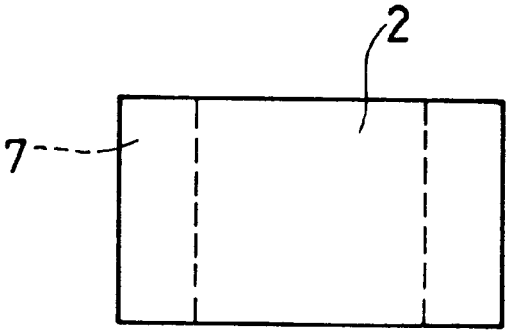

In addition, as shown in FIG. 15, the electrodes 7 may be linearly formed on one surface of the heating element 2 in the thickness-wise direction which can come in contact with the heating element retaining pieces 33 of the holders 5 and both the sides of the heating element 2 in the lengthwise direction of the heater main body 1 so as to be along the lengthwise direction. As a result, by using the heater main body 1 with its one side facing towards a subject to be heated, the subject to be heated can be heated quickly as mentioned above, and use of silver paste for the electrodes 7 can be further suppressed, thereby decreasing the manufacturing costs.

Figure 16:
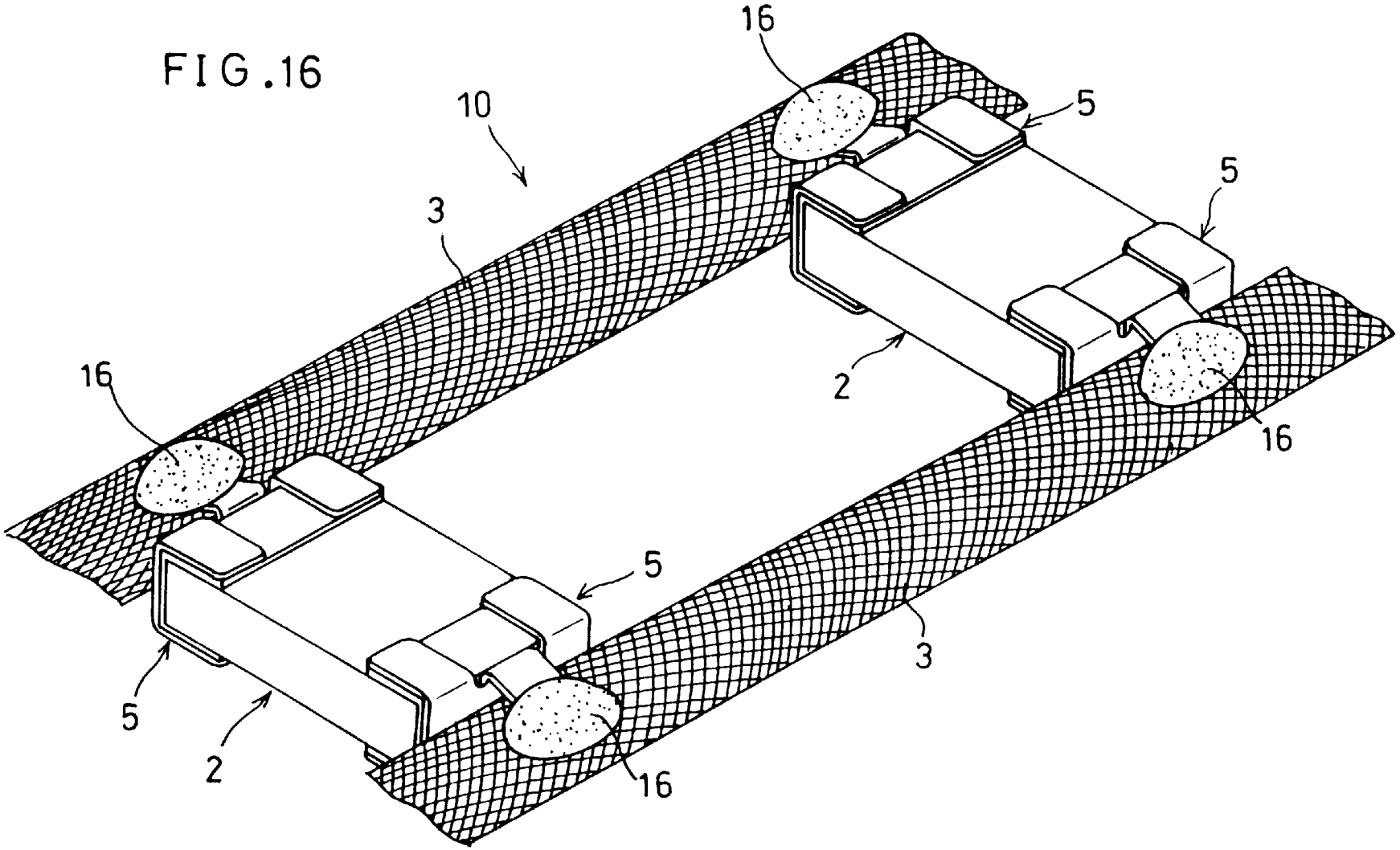
FIG. 16 is a perspective view which shows a main portion of the heat generating unit in which the holders are soldered on the feeders are soldered.
Figure 17A:
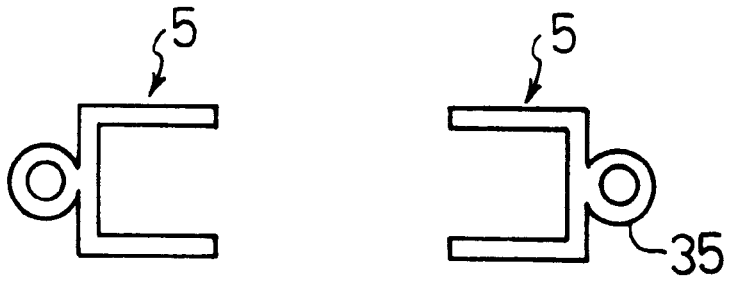
FIGS. 17(*a*), 17(*b*), 17(*c*) and 17(*d*) are front views which respectively show modifications of a feeder retaining piece of the holder.
Figure 17B:
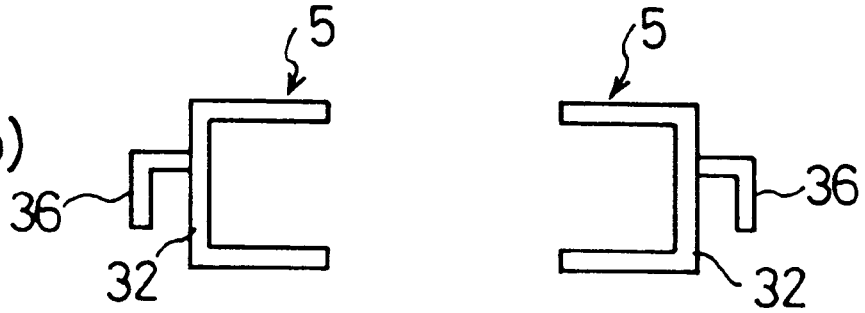
Figure 17C:
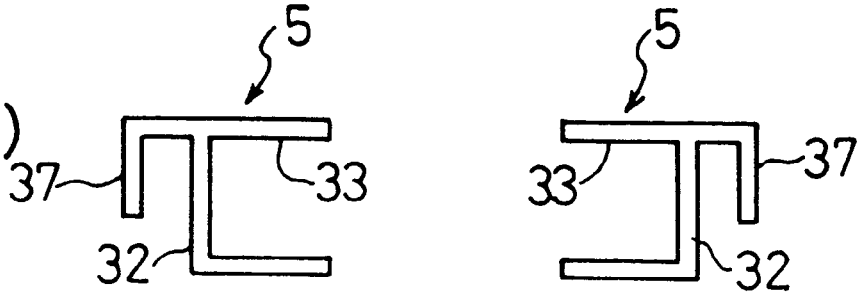
Figure 17D:
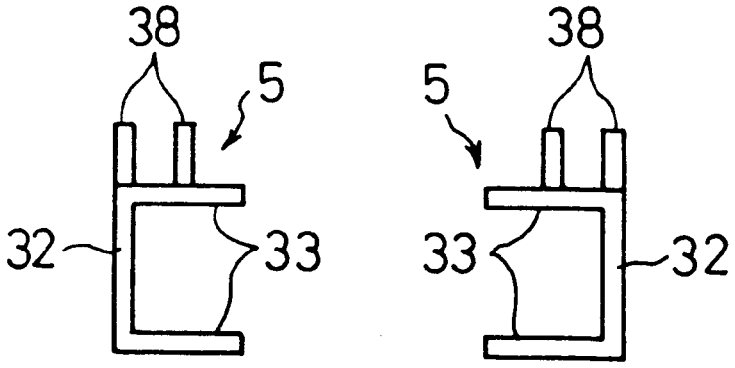

Further, as shown in FIG. 16, the feeder retaining pieces 34 and the feeders 3 are fixed by solders 16, and the heating element retaining pieces 33 and portions where the bottom portions 32 and the electrodes 7 of the heating element 2 can be fixed by sticking them using adhesive tape and an adhesive having conductivity or by soldering.

In such a manner, when the heating element 2 and the feeders 3 are joined by the holders 5 and the feeders 3 are fixed to the holders 5 with solders 16, the connecting strength between the feeders 3 and the heating element 2 can be further improved.

Accordingly, since the strong connecting strength can be obtained in opposition to a stress, which is produced by deflection of the feeders 3 when the heater main body 1 is wound around the water pipe in a spiral and is stuck along the lengthwise direction of the water pipe, the arrangement can be further resistant to bending. For this reason, the connecting portion between the heating element 2 and the feeders 3 can be prevented from disconnecting. Moreover, since the heating element 2 is electrically connected to the feeders 3 securely, the water-residence portion can be heated more efficiently and more securely.

In addition, in embodiment 1, the feeder retaining pieces 34 of the holder 5 are projected towards the widthwise direction of the heater main body 1 so that their backs face each other, but the arrangement is not limited to this, so instead of the feeder retaining pieces 34, as shown in FIG. 17(*a*), for example, feeder retaining rings 35 which surround and come in contact with the whole circumferences of the feeders 3 can be provided. In accordance with the shape of the feeder retaining rings 35, even if a external force is mechanically applied to the feeders 3 from the outside, the feeders 3 are not hardly disconnected from the feeder retaining rings 35, thereby insuring the electrical connection between the feeder 3 and the holders 5.

Further, instead of the feeder retaining pieces 34, as shown in FIG. 17(*b*), feeder retaining pieces 36 with L-shaped section can be provided so as to be projected outwardly from the central portions of the bottom sections 32 of the holder 5. Since the feeder retaining pieces 36 can engage the heating element 2 having the holders 5 with the feeders 3 easily, each feeder retaining piece 36 can be easily installed between a pair of feeders 3.

Furthermore, instead of the feeder retaining pieces 34, as shown in FIG. 17(*c*), feeder retaining piece 37 having L-shaped section can be provided so as to be extended outwardly from one of the feeder retaining pieces 33. Since the feeder retaining pieces 37 can engage the heating element 2 having the holders 5 with the feeders 3, each feeder retaining piece 37 can be easily installed between a pair of feeders 3.

Further, instead of the feeder retaining pieces 34, as shown in FIG. 17(*d*), a pair of feeder retaining pieces 38 can be provided so as to be extended outwardly along the surface of the bottom section 32 from one of the feeder retaining pieces 33.

In the case where the feeder retaining pieces 36, 37 and 38 respectively shown in FIGS. 17(*b*) through 17(*d*) are provided, in order to insert the feeders 3, the feeder retaining pieces 36, 37 and 38 can be installed only by dropping them from above without enlarging intervals of the feeders 3, thereby simplifying the process of installing the feeder retaining pieces to the feeders 3.

Figure 18A:
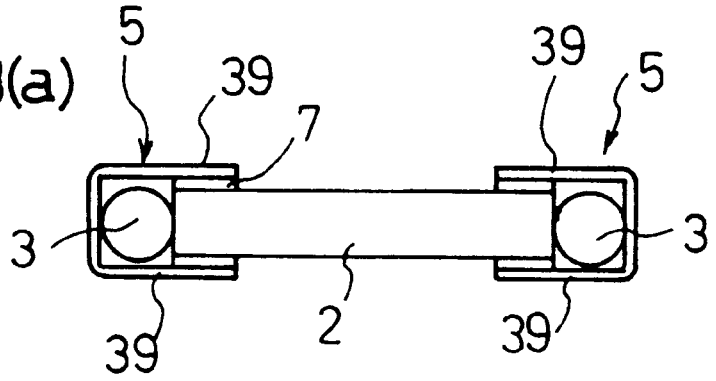
FIGS. 18(*a*) and 18(*b*) are explanatory drawings which show another modifications of the holder; 18(*a*) is a front view.
Figure 18B:
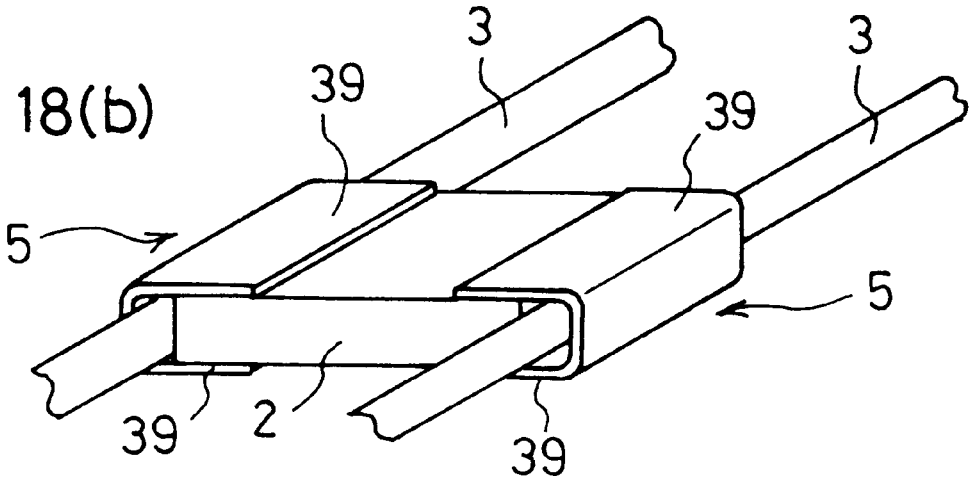

In addition, in embodiment 1, the holder 5 is arranged so that the feeder retaining pieces 34 face the heating element retaining pieces 33 on their backs, but instead of the holder 5, as shown in FIG. 18, for example, the holder 5 with U-shaped section may be used. Such holders 5 are formed so that retaining pieces 39, which retain the feeders 3, can respectively come in contact with the electrodes 7 of the heating element 2 with the points of the retaining pieces 39 being further extended. When this arrangement of the holder 5 is simplified, the manufacturing of the holder 5 becomes easy.

Figure 19A:
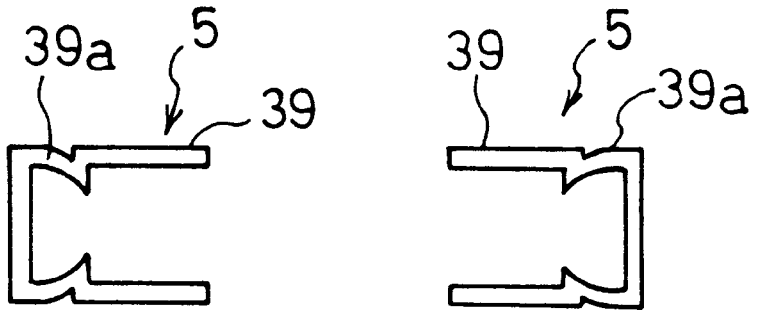
FIGS. 19(*a*), 19(*b*) and 19(*c*) show other modifications of the holder.
Figure 19B:
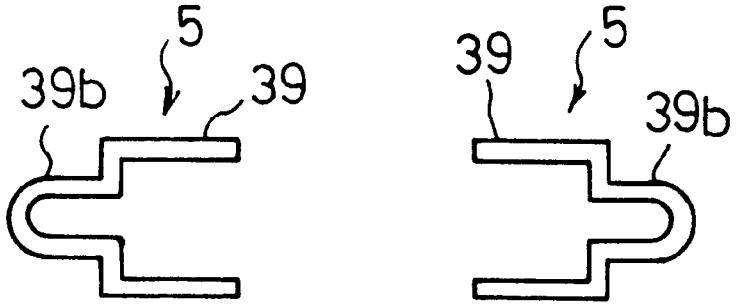
Figure 19C:
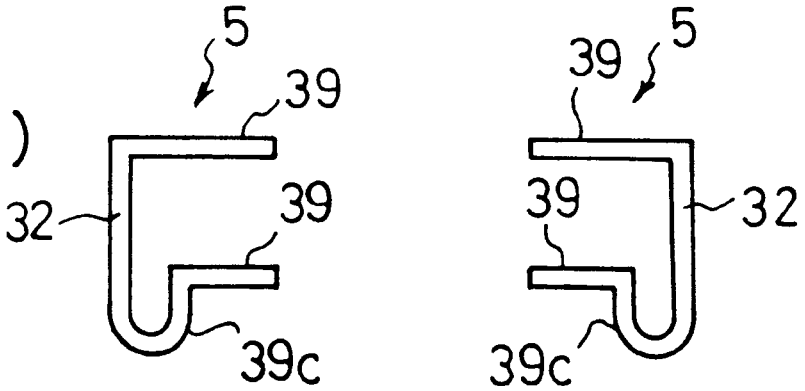

Furthermore, as shown in FIG. 19(*a*), the retaining pieces 39 may be respectively provided with taper sections 39*a* which are constructed so as to be able to come closer to each other. Such taper sections 39*a* can retain the feeders 3 more firmly.

In addition, as shown in FIG. 19(*b*), the retaining pieces 39 may be respectively provided with feeder retaining sections 39*b* with their intervals being set smaller. The feeder retaining sections 39*b* can retain the feeders 3 more firmly.

Further, as shown in FIG. 19(*c*), feeder retaining sections 39*c*, which are swelled to the outward of a direction along the surface of the bottom portion 32, may be respectively provided to one of the retaining pieces 39 of the holder 5. By using such feeder retaining sections 39*c*, the feeders 3 can be retained more firmly, and a width of the obtained heater main body 1 can be set smaller by widths of the feeders 3.

Figure 20A:
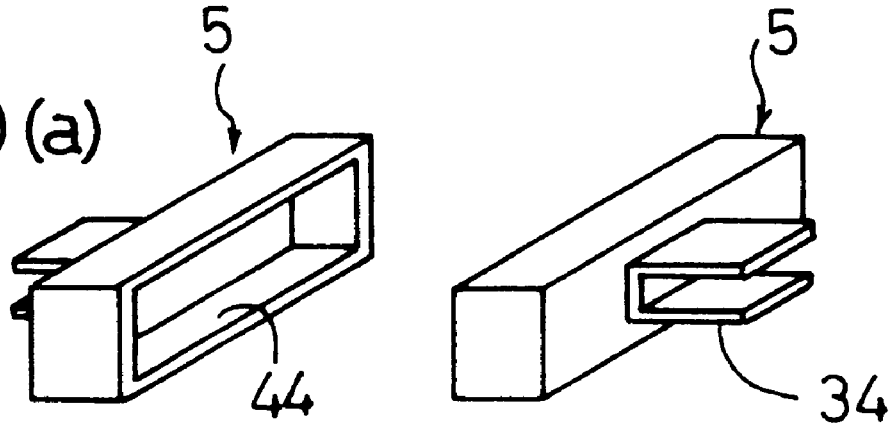
FIGS. 20(*a*) and 20(*b*) are explanatory drawings which show still another modifications of the holder.
Figure 20B:
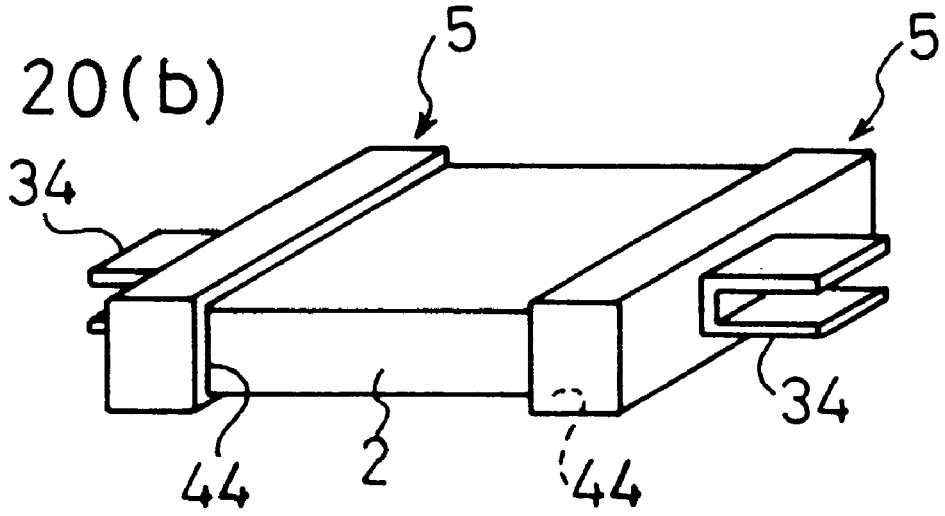
Figure 21:
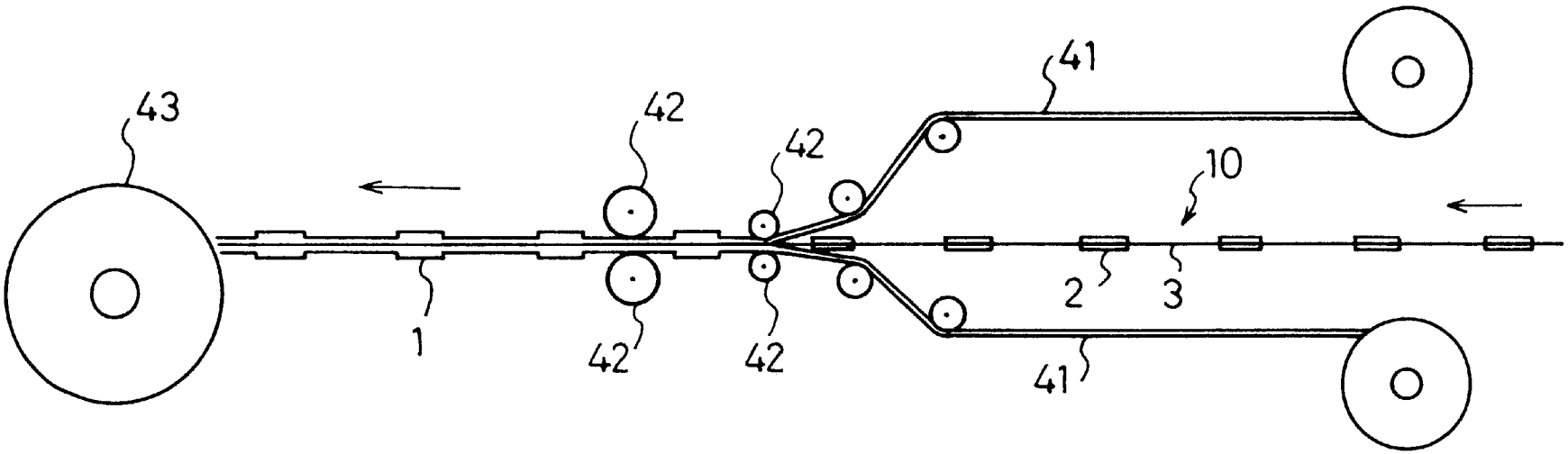
FIG. 21 is an arrangement drawing which shows another manufacturing method of the heater of the present invention.
Figure 22:
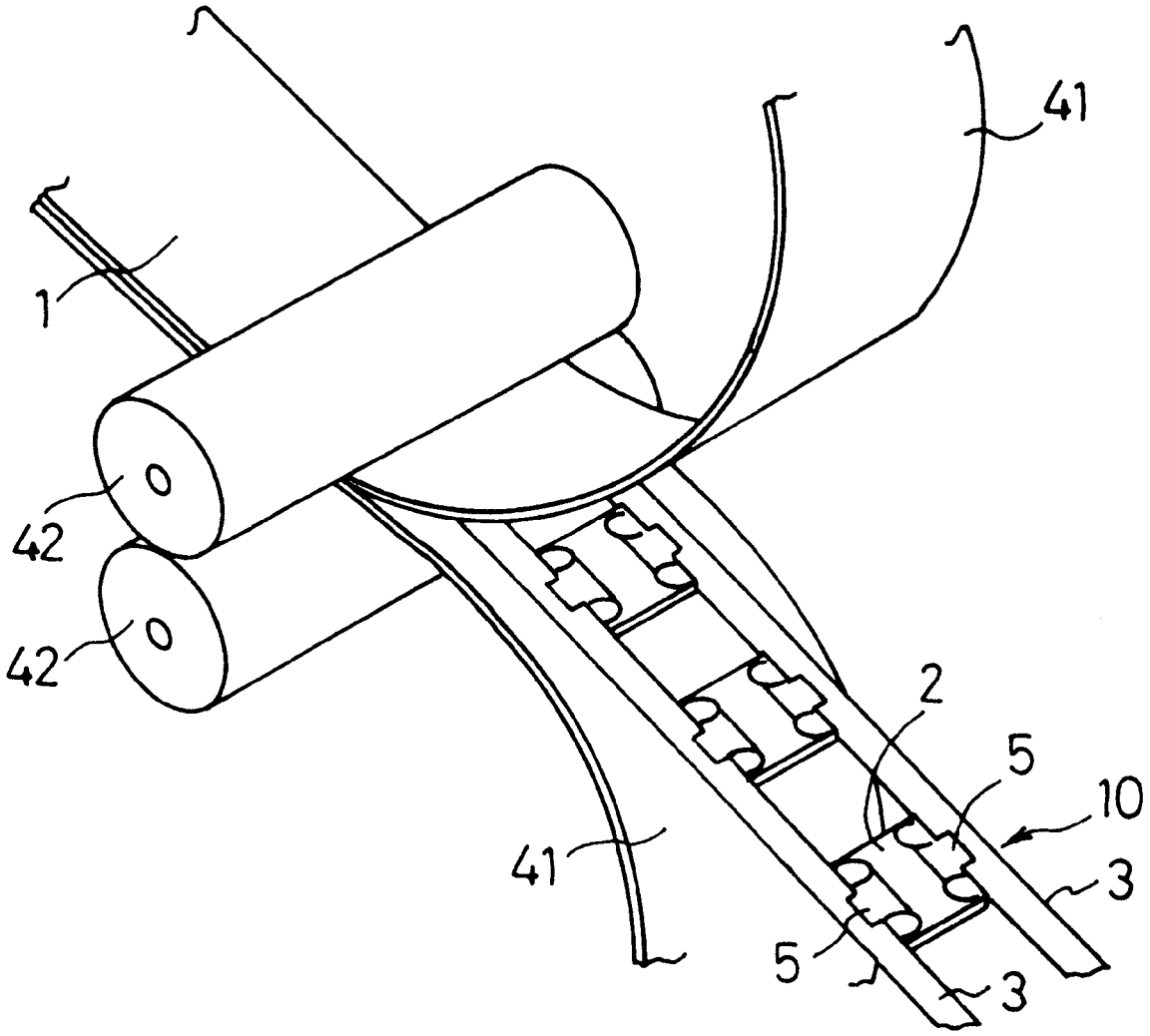
FIG. 22 is an enlarged drawing of a main portion in the manufacturing method.
Figure 23:
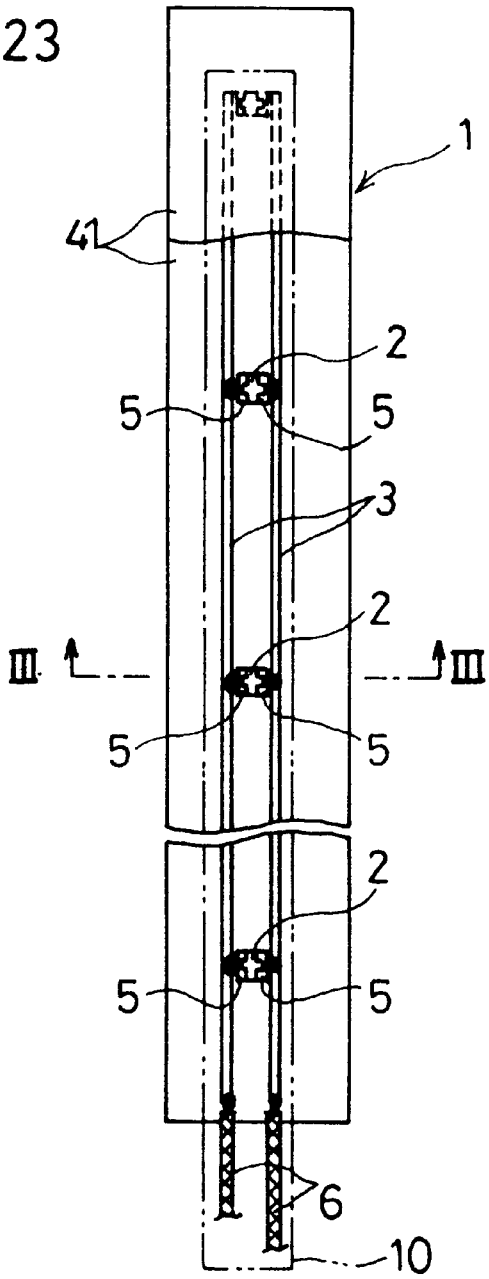
FIG. 23 is a broken cross sectional view which shows a main portion of the heater.
Figure 24:
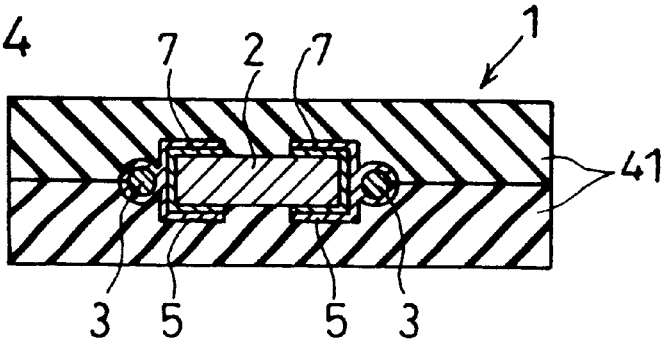
FIG. 24 is a cross sectional view taken along a line III—III in the heater.

In addition, in embodiment 1, the holder 5 was manufactured by punching a metallic plate, but as shown in FIG. 20, for example, the holder 5, which has a heating element engaging sections 44 and the feeder retaining pieces 34 may be manufactured by casting. The heating element engaging section 44 and the feeder retaining pieces 34 retain the end portions of the heating element 2 with the electrodes 7 by engagement. The heating element engaging sections 44 correspond to the heating element retaining pieces 33.

Further, in the manufacturing method of embodiment 1, the heater main body 1 was manufactured by extrusion molding, but as shown in FIGS. 21 through 24, for example, the heater main body 1 into which the heating unit 10 was sealed may be manufactured such that the heating unit 10 is sandwiched between sheets 41 made of a thermoplastic resin such as a vinyl chloride resin, and the sheets 41 are stuck to each other by thermocompression bonding using a heating roll 42.

In accordance with the above method, since the heater main body 1 can be rolled up around a winding roll 43, the manufacturing of the heater main body 1 becomes easy as mentioned above. Moreover, since the heater main body 1 can be manufactured only by sticking the sheets 41 to each other through heating, the manufacturing steps can be simplified more than the case of using an extruder.

In the above method, the vinyl chloride resin was used as a material of the sheet 41, but butyl rubber having a self-welding characteristic may be used as a material.

In this case, both sides of the heating unit 10 in the thickness-wise direction of the heating element 2 in the heating unit 10 are sandwiched by a pair of sheets 41, and the heating unit 10 sandwiched by the sheets 41 are respectively shaped with its circumference being held down. As a result, the sheets 41 are stuck to each other to be united by the self-welding characteristic of the sheets 41 so that the heating unit 10 is coated with the sheets 41, and thus the heater main body 1 is obtained.

Therefore, in accordance with the above method, troubles of adhering the sheets 41 and drying a used adhesive in order to coat the heating unit 10 can be omitted, thereby simplifying the manufacturing process.

Embodiment 2

Figure 25:
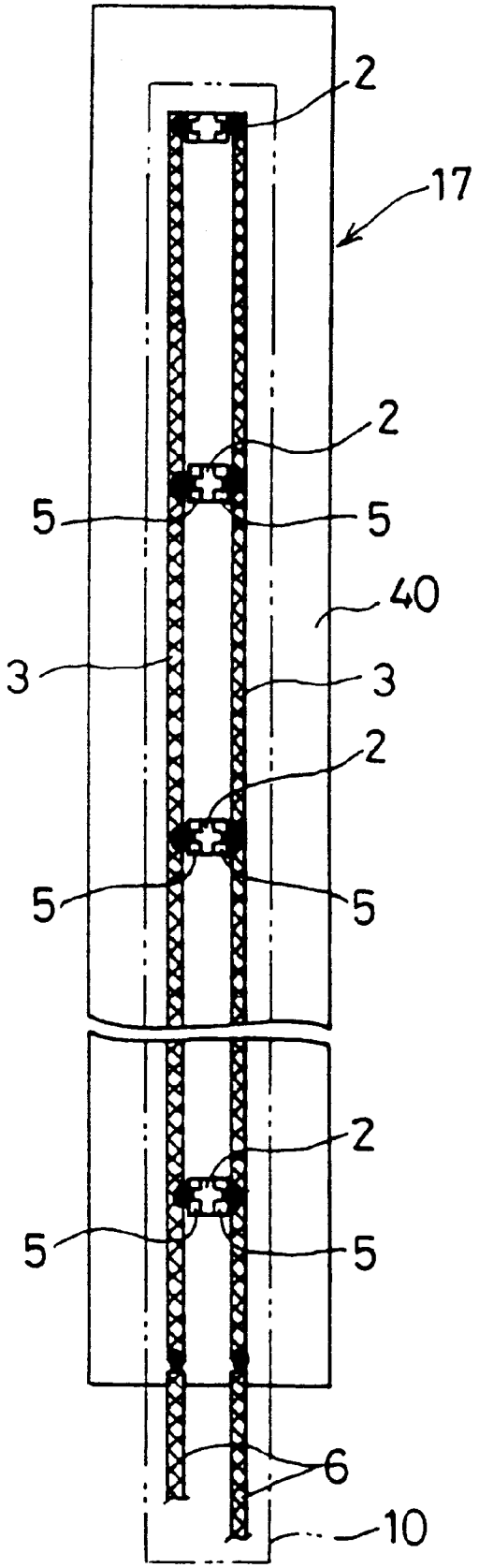
FIG. 25 is an explanatory drawing of the heater according to embodiment 2 of the present invention.

The following describes another embodiment of the present invention as embodiment 2 on reference to FIG. 25. Here, for convenience of explanation, those members that have the same arrangement and functions, and that are described in the aforementioned embodiment 1 are indicated by the same reference numerals and the description thereof is omitted.

As shown in FIG. 25, in a heater in embodiment 2, a heater main body 17 is provided with a supporter 40 which holds the heating unit 10 composed of the heating elements 2, the feeders 3 and the holders 5 with the heating unit 10 being exposed. The supporter 40 is composed of a thermoplastic resin such as a vinyl chloride resin.

When the heating unit 10 is stuck to the supporter 40 in such a manner, adhesive tape or an adhesive, not shown, is provided to the rear sides of the feeders 3, and the feeders 3 and the supporter 40 are fixed by the adhesive tape or an adhesive so as not to be moved. As a result, the heating unit 10 is stably held by the supporter 40.

In the arrangement according to embodiment 2 of the present invention, the supporter 40 is provided only to one surface of the heating unit 10. As a result, if the heater main body 17 is wound in a spiral around the outer circumference of the water pipe along an axial direction of the water pipe, and then the heater main body 17 is coated with glass wool and insulating tape, for example, convex portions are concentrated on only one side. For this reason, the heater main body 17 is bent more easily than the case where the whole surface of the heating unit 10 is coated.

Therefore, even in the case of the water pipe having large curvature, i.e., a small diameter, the heater main body 17 can be reasonably wound around the outer circumference of the water pipe along its axial direction. Moreover, the heater main body 17 is not wound in a spiral around the water pipe, but the heater main body 17 may be stuck to the water pipe along the lengthwise direction of the water pipe.

In addition, one side of the heating element 2 is not covered with the supporter 40, namely, is exposed. As a result, the heating elements 2 quickly respond to a change in an outside air temperature, and thus the resistance value of the heating elements 2 can be changed more quickly. Therefore, the curved surface of the water pipe can be quickly heated by the heating elements 2, thereby ensuring the prevention of freezing of water in the water pipe.

Embodiment 3

The following describes another embodiment of the present invention as embodiment 3 on reference to FIGS. 26 through 32. Here, for convenience of explanation, those members that have the same arrangement and functions, and that are described in the aforementioned embodiments are indicated by the same reference numerals and the description thereof is omitted.

Figure 26:
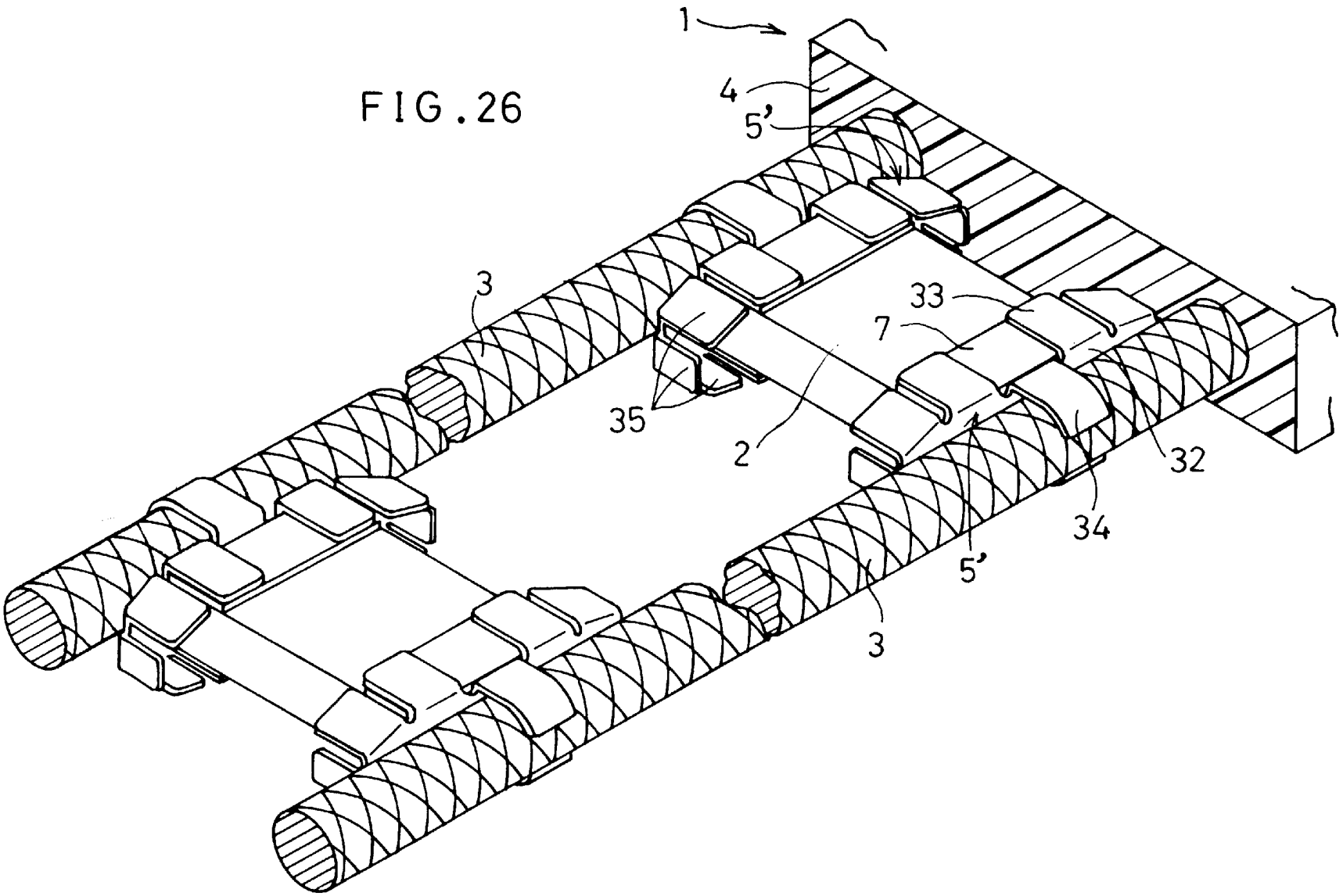
FIG. 26 is an explanatory drawing of the heater according to embodiment 2 of the present invention.
Figure 27:
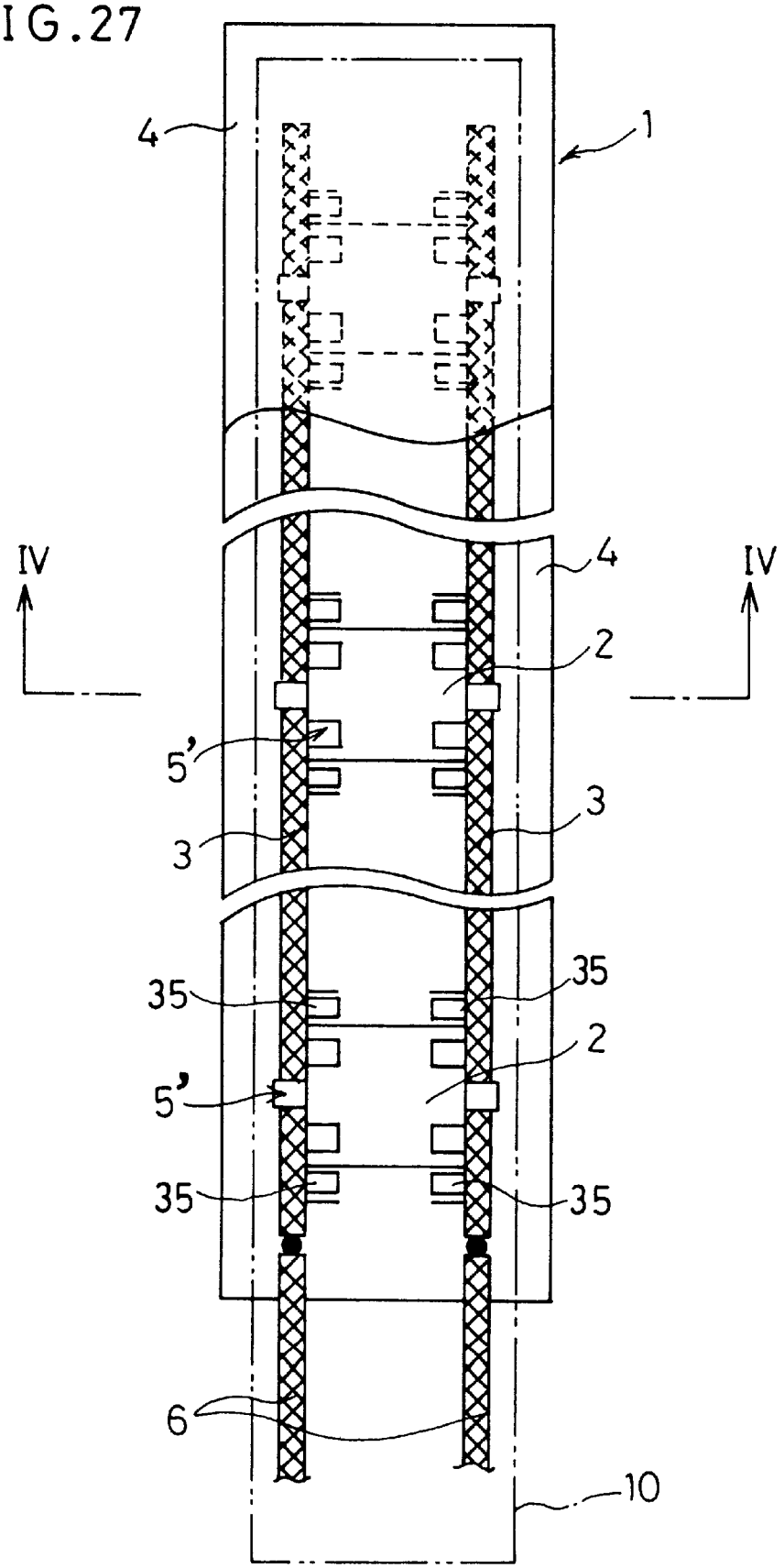
FIG. 27 is a broken cross sectional view which shows a main portion of the heater.
Figure 28:
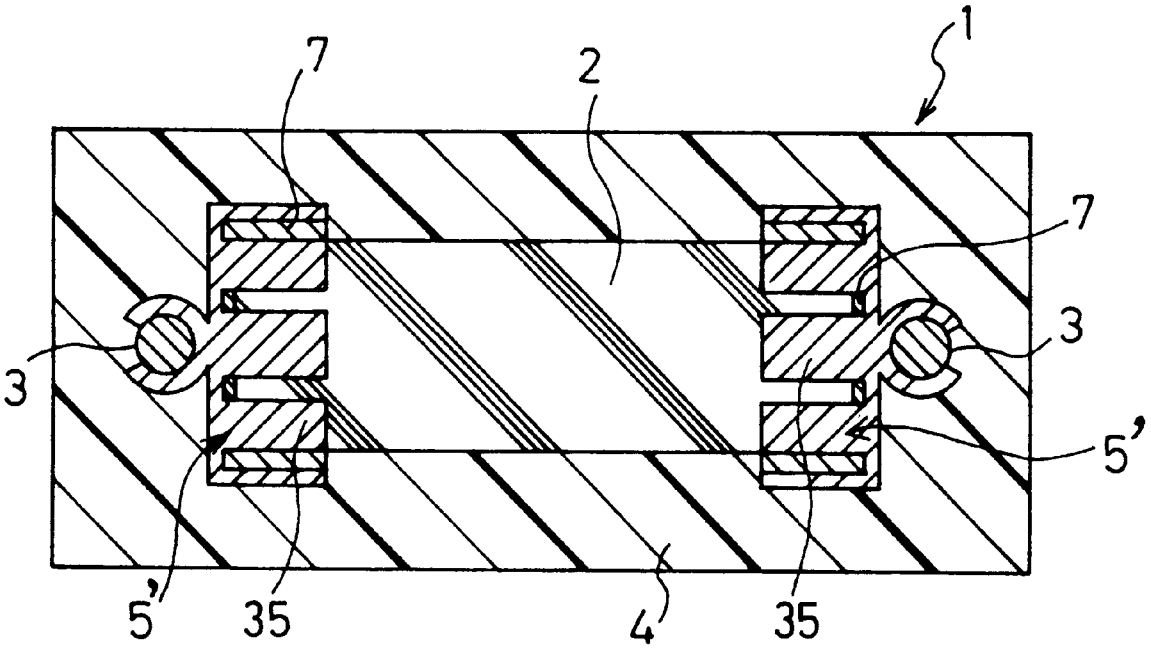
FIG. 28 is a cross sectional view taken along a line IV—IV in the heater.

In a heater according to embodiment 3, as shown in FIGS. 26 through 28, instead of the holders 5, holders 5' having protective pieces 35 protecting the heating elements 2 are used. The protective pieces 35 are projected so as to cover front sides and rear sides of the heating elements 2 with respect to the extrusion direction of the extrusion molding.

Figure 29A:
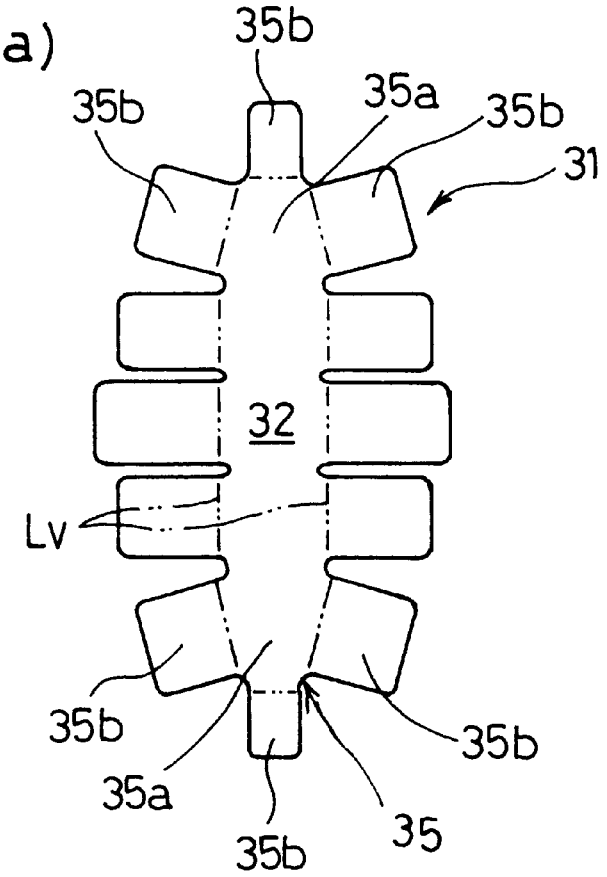
FIGS. 29(*a*) and 29(*b*) show arrangements of the holder in the heater.
Figure 29B:
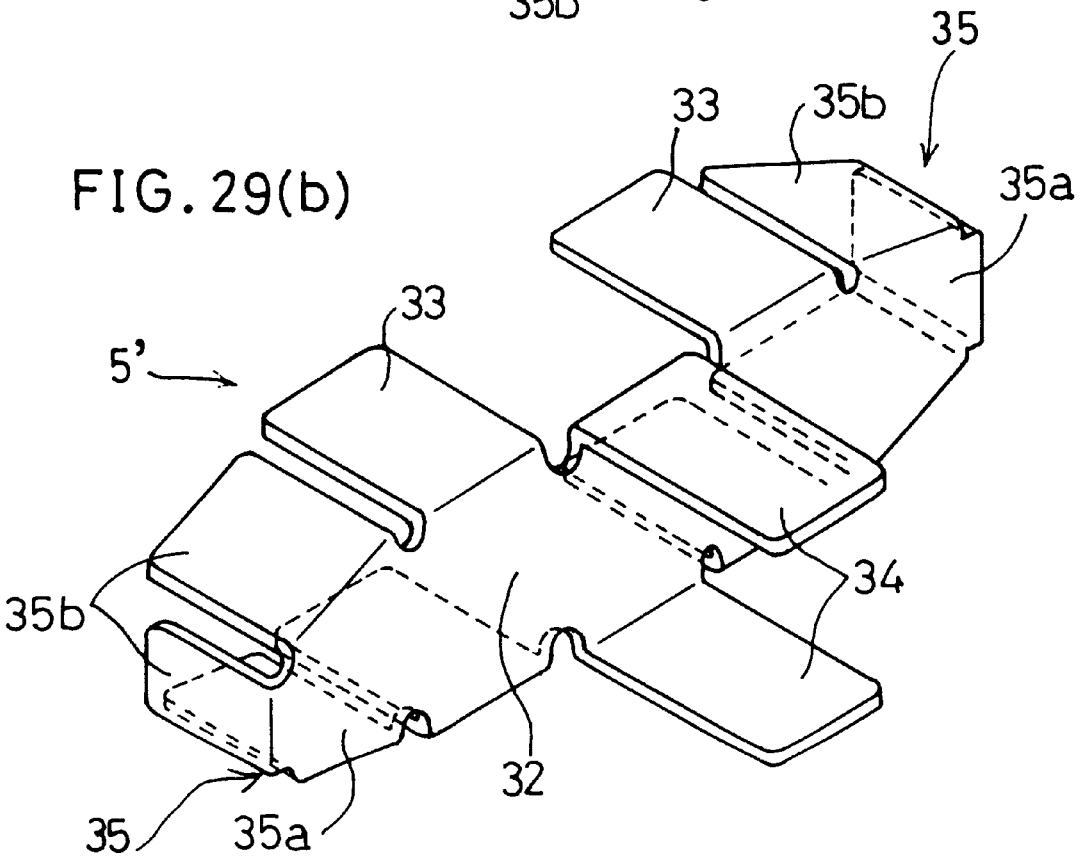

As shown in FIG. 29(*b*), the protective pieces 35 respectively have projected pieces 35*a*, which are projected forward and backward along the extrusion direction. The projected pieces 35*a* are tapered so that the lengths of the heating elements 2 in the thickness-wise direction become shorter towards the point.

In addition, the protective pieces 35 respectively have extended pieces 35*b* which are extended on both the end surfaces of the heating element 2 in the extrusion direction from both sides of each projected piece 35*a* in a thickness-wise direction and from the points of the projected pieces 35*a*. As shown in FIG. 29(*a*), such a holder 5' can be easily manufactured by bending a metallic plate 31, which was punched as mentioned above.

Figure 30:
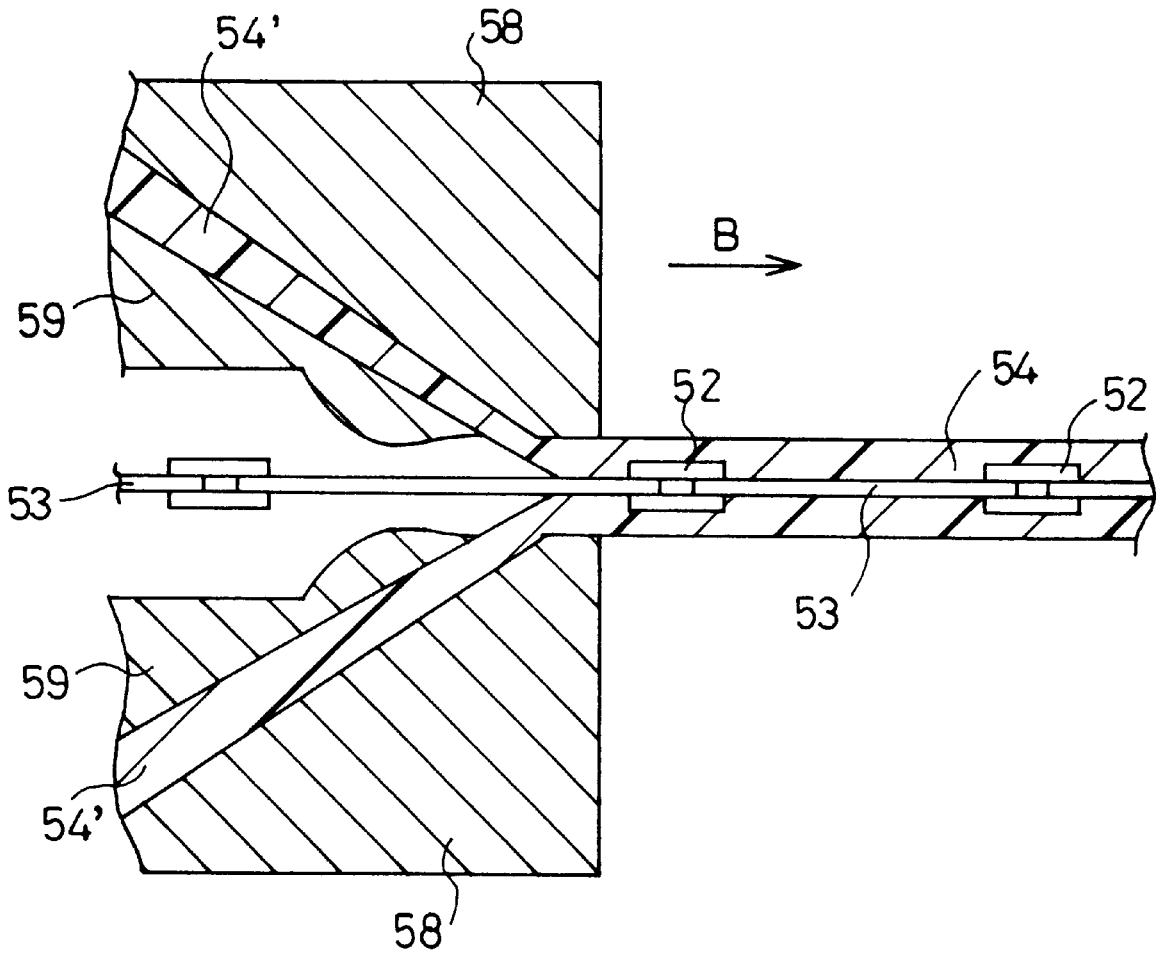
FIG. 30 is an explanatory drawing which shows that a breakage easily occurs in the heating element of a conventional heater when the heater is manufactured.

As shown in FIG. 30, when rectangular parallelepiped heating elements 52 are sealed into a cord-like coating material 54 by extrusion-molding a thermoplastic resin 54' together with feeders 53, the heating element 52 is shifted from a central portion of a die 58 as the extrusion exit by the vibration at the time of extrusion, and a front side of the heating element 52 with respect to an extrusion direction B of an extruder is brought into contact with a nipple 59 and the die 58 at the extrusion exit. As a result, the hard and fragile heating element 52 does not generate heat due to damage caused by the contact, thereby presenting a problem in that the heating element 52 cannot partially fulfil its function as a heater.

Figure 31:
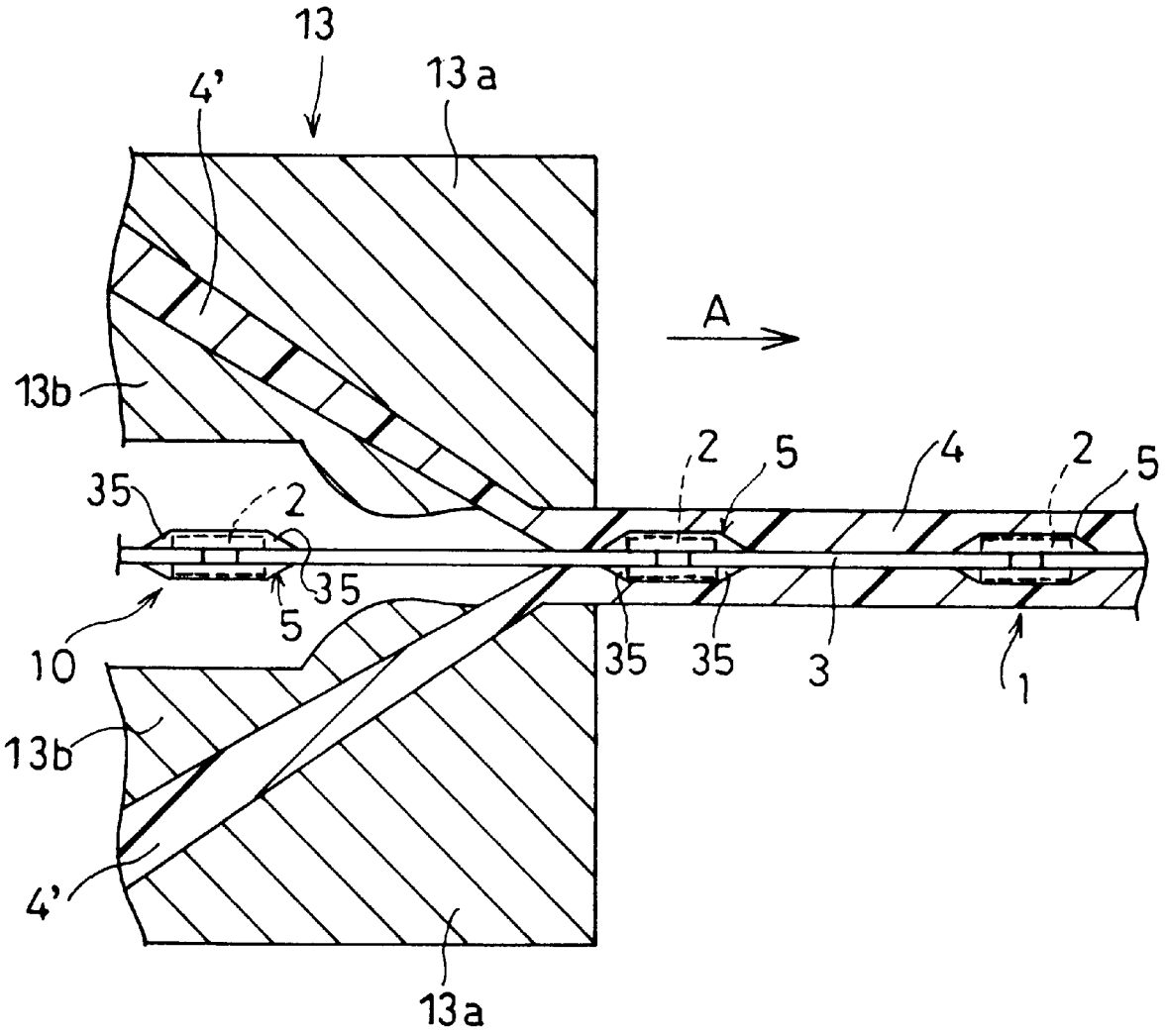
FIG. 31 is an explanatory drawing which shows that the heating element is protected against a breakage by the holder.

However, in the arrangement of embodiment 3, since the protective pieces 35 cover the front side of the heating element 2, even if as shown in FIG. 31, the heating element 2 comes so close to the nipples 13*b* and dies 13*a* at the time of the extrusion molding that it almost come into contact with them, the protective pieces 35 of the holder 5' intervene between the heating element 2 and the nipples 13*b* or the dies 13*a*. For this reason, the heating element 2 is protected by the protective pieces 35. Therefore, in the above arrangement, damage of the heating element 2 can be prevented.

Meanwhile, when a rear side of the heating element 2 is covered with the protective pieces 35, a range of elastic compression of a thermoplastic resin 4' which passes between the dies 13*a* is dispersed in a wide area of the holders 5'. As a result, a change in the positions of the heating elements 2 due to the elastic compression can be suppressed, and thus the positions of the heating elements 2 can be controlled so as to come to the central portion of the heater main body 1.

Figure 32A:
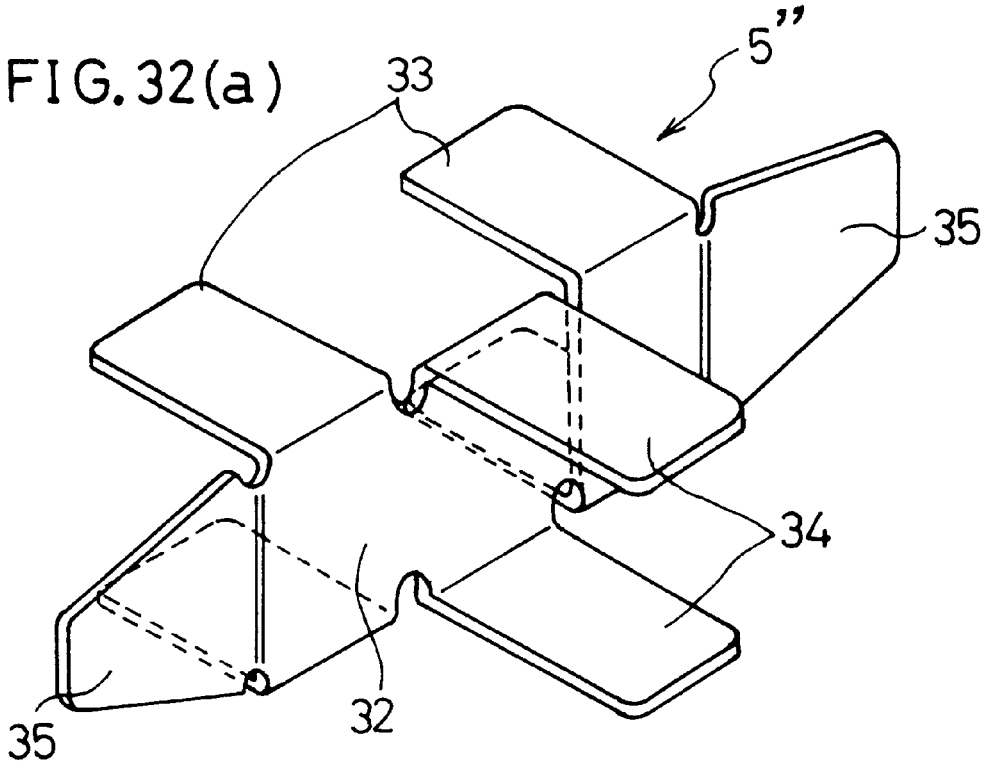
FIGS. 32(*a*) and 32(*b*) are other examples of holder instead of the above holders.
Figure 32B:
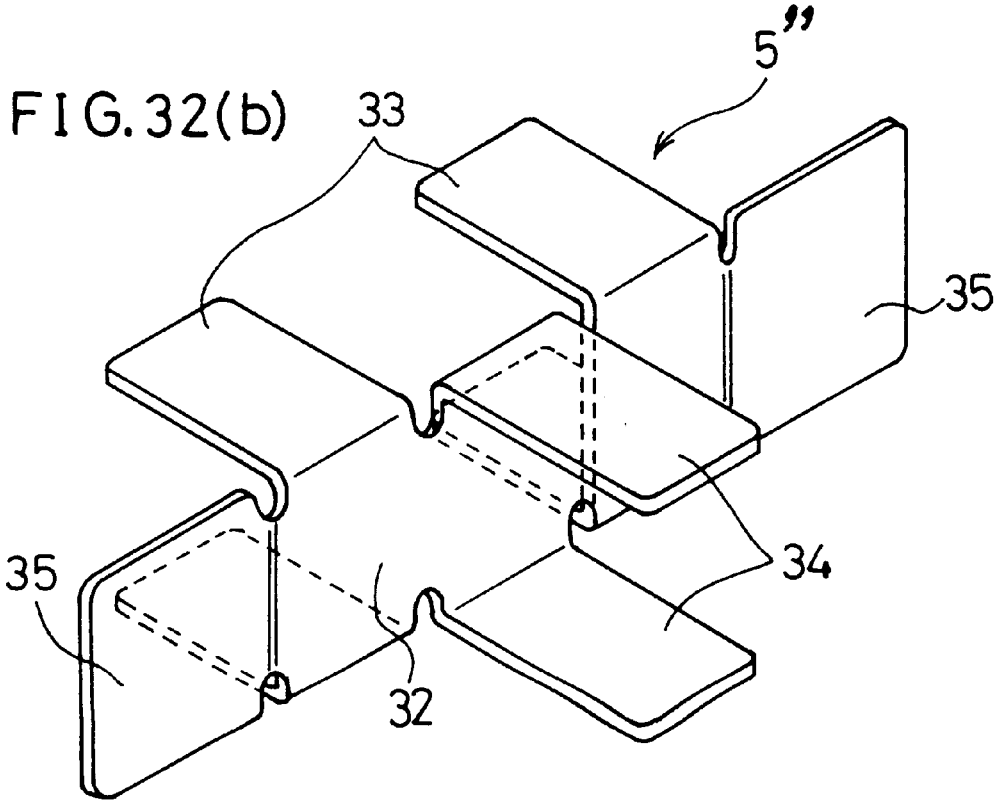

An example of another shape of the holder 5' is shown in FIG. 32 as the holder 5". Since a portion of the holder 5", which is bent in U-shape towards the front side and the rear side of the heating element 2 with respect to the extrusion direction of the extrusion molding, is omitted, the steps of manufacturing the holder 5" can be decreased more than the holder 5' shown in FIG. 29, thereby reducing trouble of manufacturing.

Embodiment 4

Figure 33:
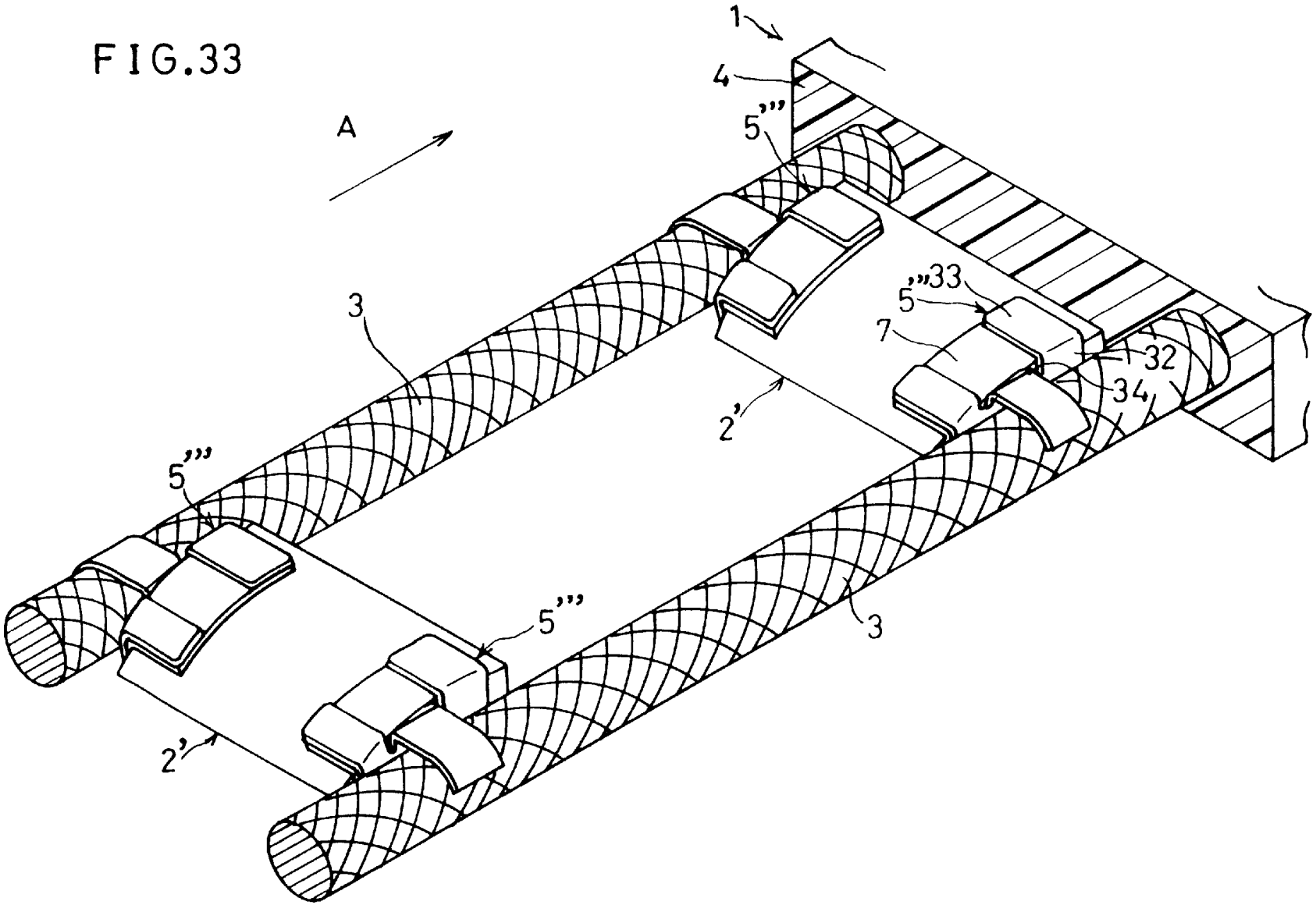
FIG. 33 is a broken perspective view which shows a main portion of the heater according to embodiment 4 of the present invention.

The following describes still another embodiment of the present invention as embodiment 4 on reference to FIGS. 33 and 39. Here, for convenience of explanation, those members that have the same arrangement and functions, and that are described in the aforementioned embodiments are indicated by the same reference numerals and the description thereof is omitted.

Figure 34:
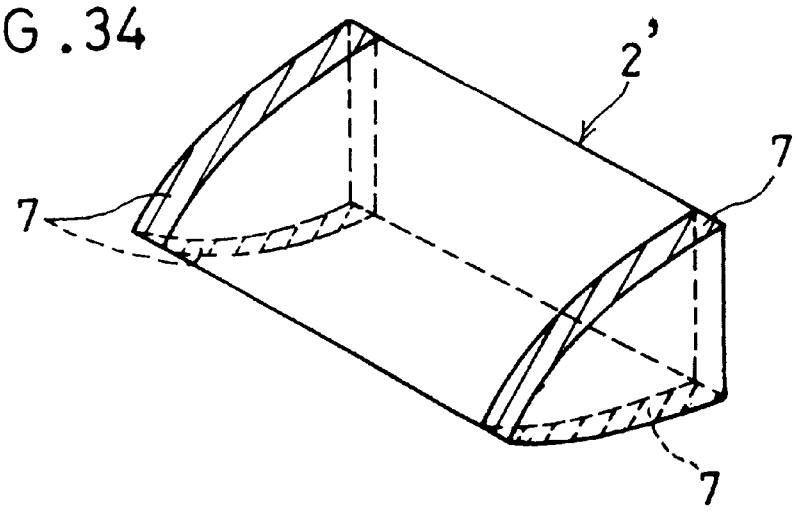
FIG. 34 is a perspective view of the heating element of the heater.

In a heater of embodiment 4, instead of the substantially rectangular parallelepiped heating elements 2, as shown in FIGS. 33 and 34, heating elements 2', whose thickness becomes thinner towards one end of the extrusion direction, are used. The heating element 2' is formed so that a surface, which is sandwiched between two sides of a triangle pole whose section becomes an isosceles triangle, is swelled outward. Moreover, in the case of embodiment 4, the heating elements 2' are placed so that their sides where the thicknesses become thinner with respect to the extrusion direction A come to a rear side.

Figure 35:
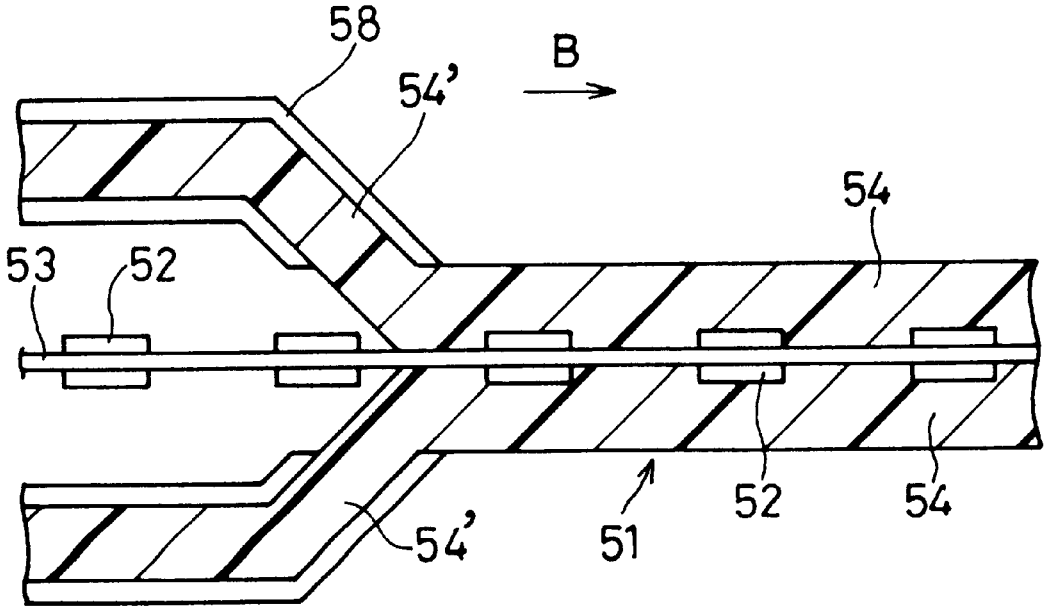
FIG. 35 is an explanatory drawing which shows that unevenness easily occurs on a surface of the heater when the conventional heater is manufactured.
Figure 36:
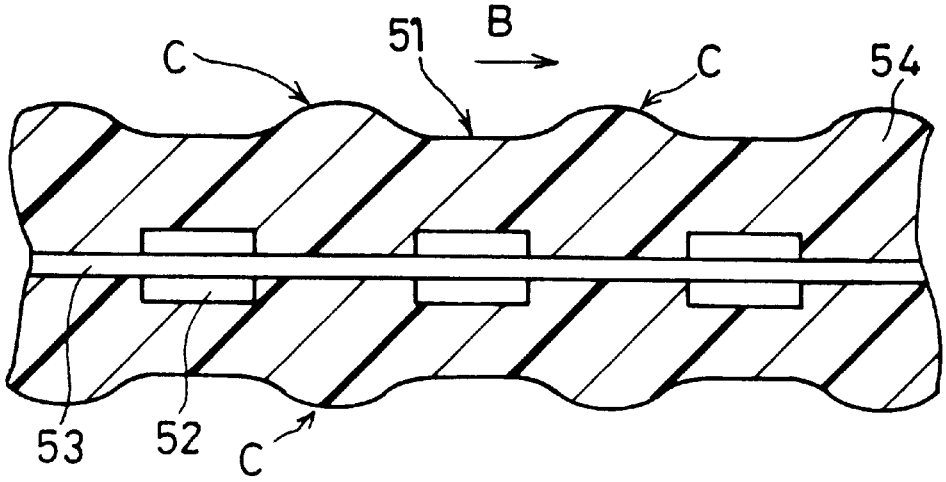
FIG. 36 is an explanatory drawing which shows that unevenness occurs in the above heater.

In the conventional manner, as shown in FIGS. 35 and 36, since the heating element 52 has a rectangular parallelepiped shape, when the heating element 52 is sealed into the cord-like main body 51 by the extrusion molding of the thermoplastic resin 54 to be a covering member, the coating with the thermoplastic resin 54 becomes irregular. For this reason, a convex portion C was formed on the surface of the main body 51. As a result, the contact characteristic of the main body 51 to a subject to be heated is lowered, and thus heating efficiency of the heating element 52 is deteriorated.

Figure 37:
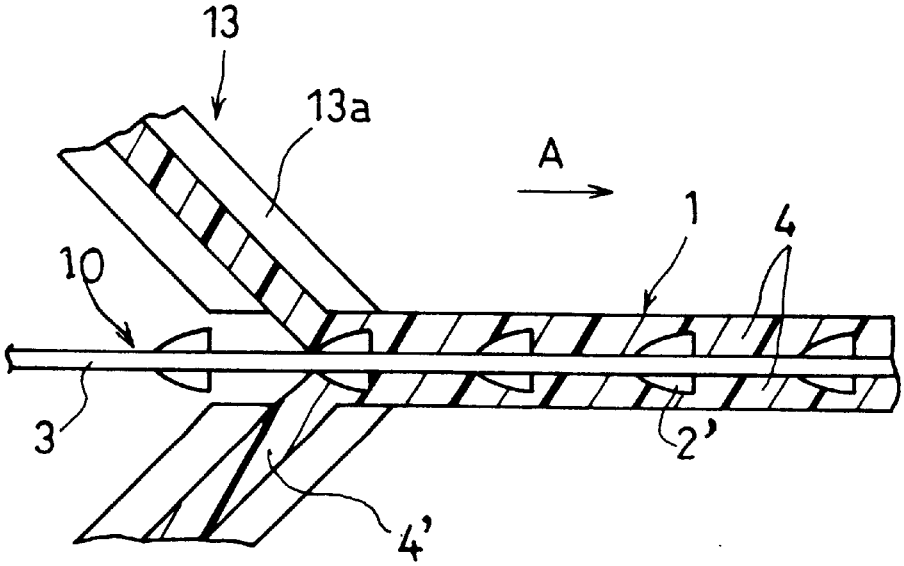
FIG. 37 is an explanatory drawing which shows that unevenness hardly occurs on the surface of the above heater by using the arrangement of the heater according to embodiment 4 of the present invention.

However, in the arrangement of embodiment 4, when the heating elements 2' shown in FIG. 34 are used, as shown in FIG. 37, a space, where a thermoplastic resin to be a covering member 4 exists, becomes larger on the rear side of the heating element 2' than the front side of the heating element 2'. As a result, backward transmission of the elastic compression of the thermoplastic resin at the time of extrusion of the heating element 2' is relieved, and thus convex portions which are formed on the surface of the heater main body 1 are suppressed more than the conventional arrangement.

As a result, in the above arrangement, the formation of unevenness of the heater main body 1 can be prevented, and thus the surface of the heater main body 1 can be smoothed. Therefore, since the above arrangement can improve the contact characteristic of the heater main body 1 to a subject to be heated, the heating efficiency of the heating element 2' can be also improved.

Further, in the conventional manner, if irregular coating of the thermoplastic resin 54 shown in FIG. 36 is remarkable, there occasionally arise problems in that the appearance is deteriorated and the heat transfer coefficient is lowered due to the irregular coating.

As to such problems, even if the heating elements 52 have a rectangular parallelepiped shape, the irregularity of resin coating can be avoided by thinning the thicknesses of the heating elements 52, but if the heating elements 52 made of ceramics are made thin, the heating elements 52 are easily damaged because they are hard and fragile. Therefore, a heater having such heating elements 52 causes a problem that heat generation easily becomes unstable.

However, in the arrangement of the present embodiment, since the irregular resin coating is avoided and the thickness of the heating element 2' does not have to be made thin, the strength of the heating element 2' can be secured, thereby eliminating such conventional problems that the appearance is deteriorated, the heat transfer coefficient is lowered and the heat generation becomes unstable.

Figure 38A:
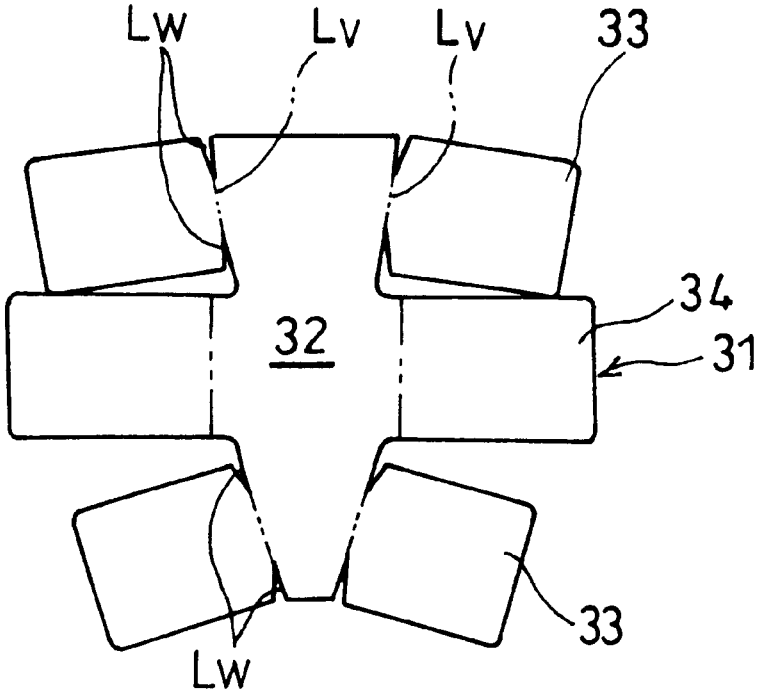
FIGS. 38(*a*) and 38(*b*) show the arrangements of the holder in the heater.
Figure 38B:
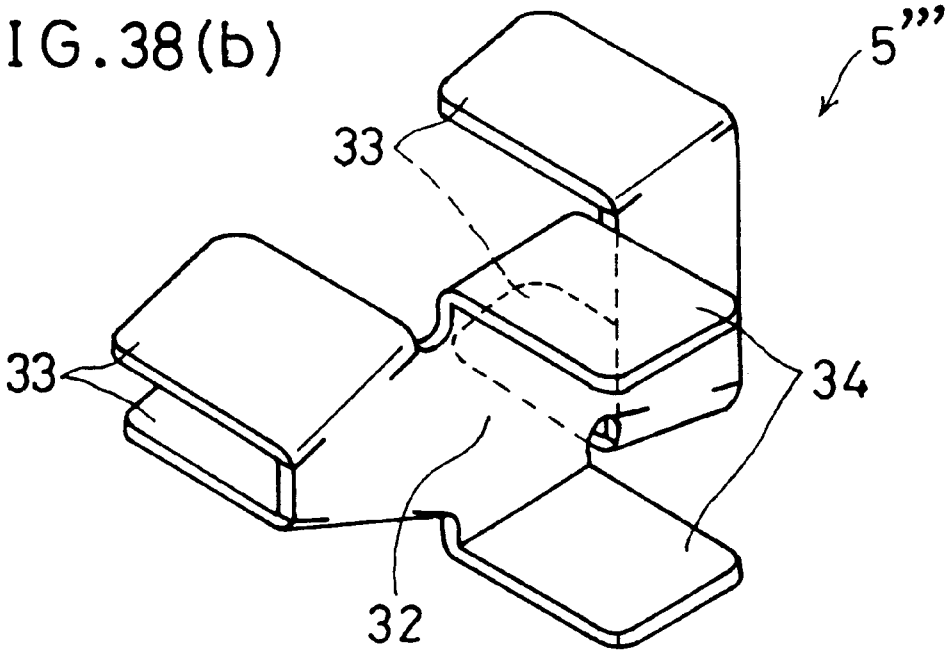
Figure 39C:
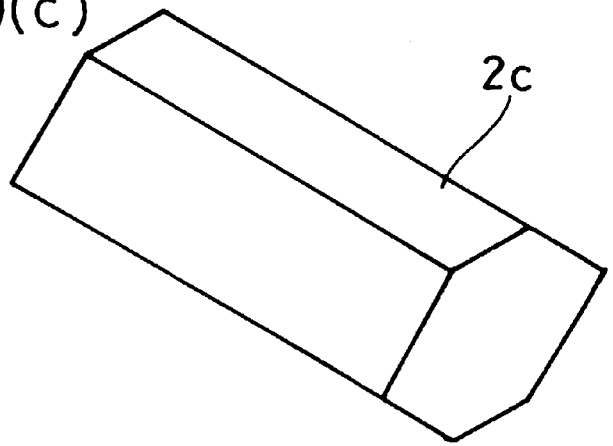
FIGS. 39(*a*), 39(*b*), 39(*c*) and 39(*c*) show modifications of shapes of the heating elements.
Figure 39D:
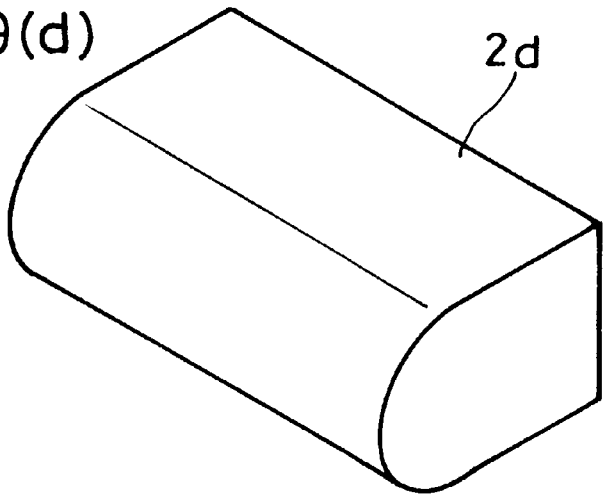
Figure 39A:
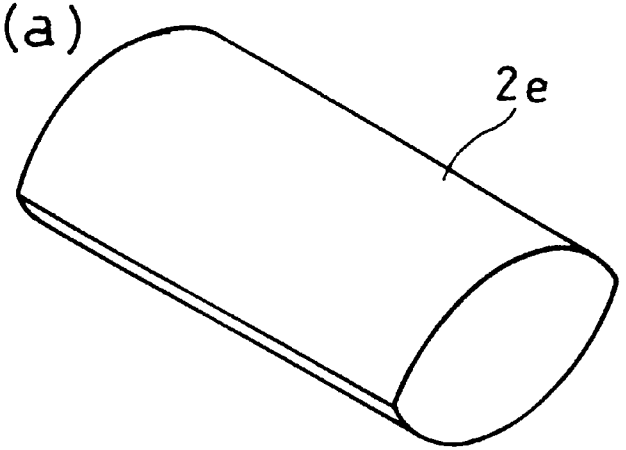
Figure 39B:
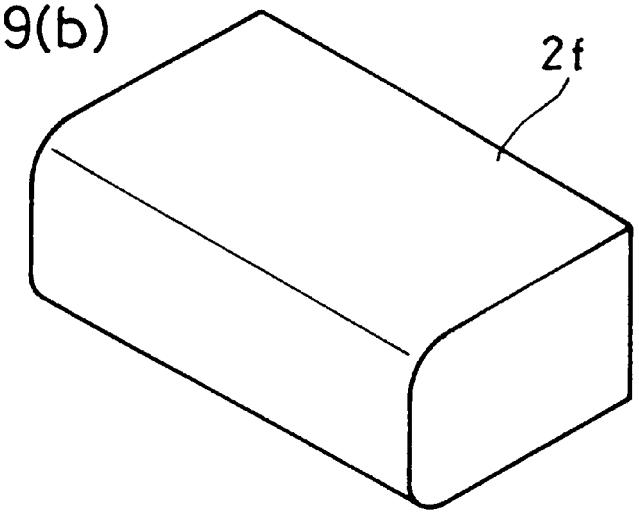
Figure 40A:
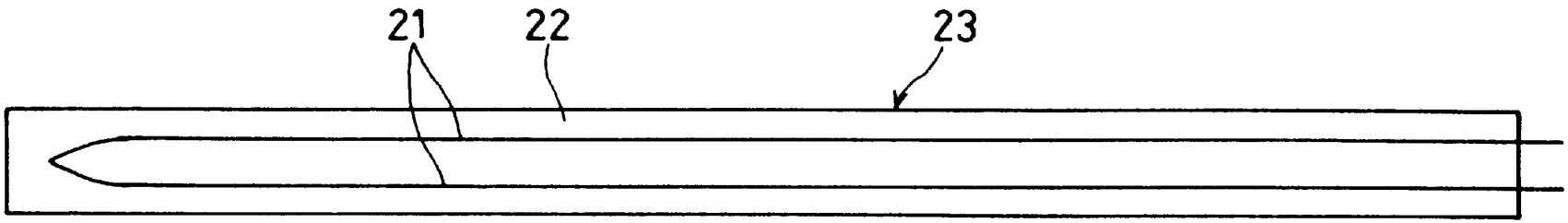
FIGS. 40(*a*) and 40(*b*) are explanatory drawings which show the conventional heater.
Figure 40B:
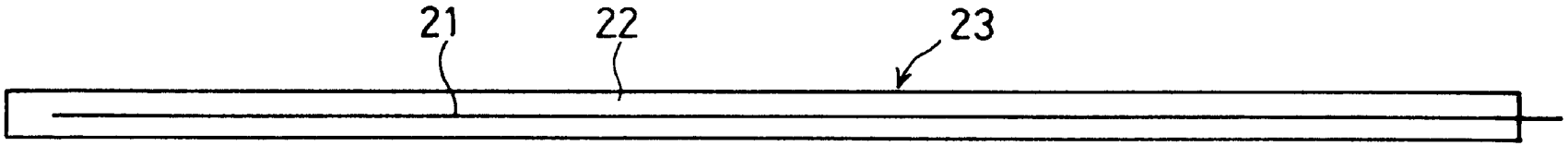
Figure 41:
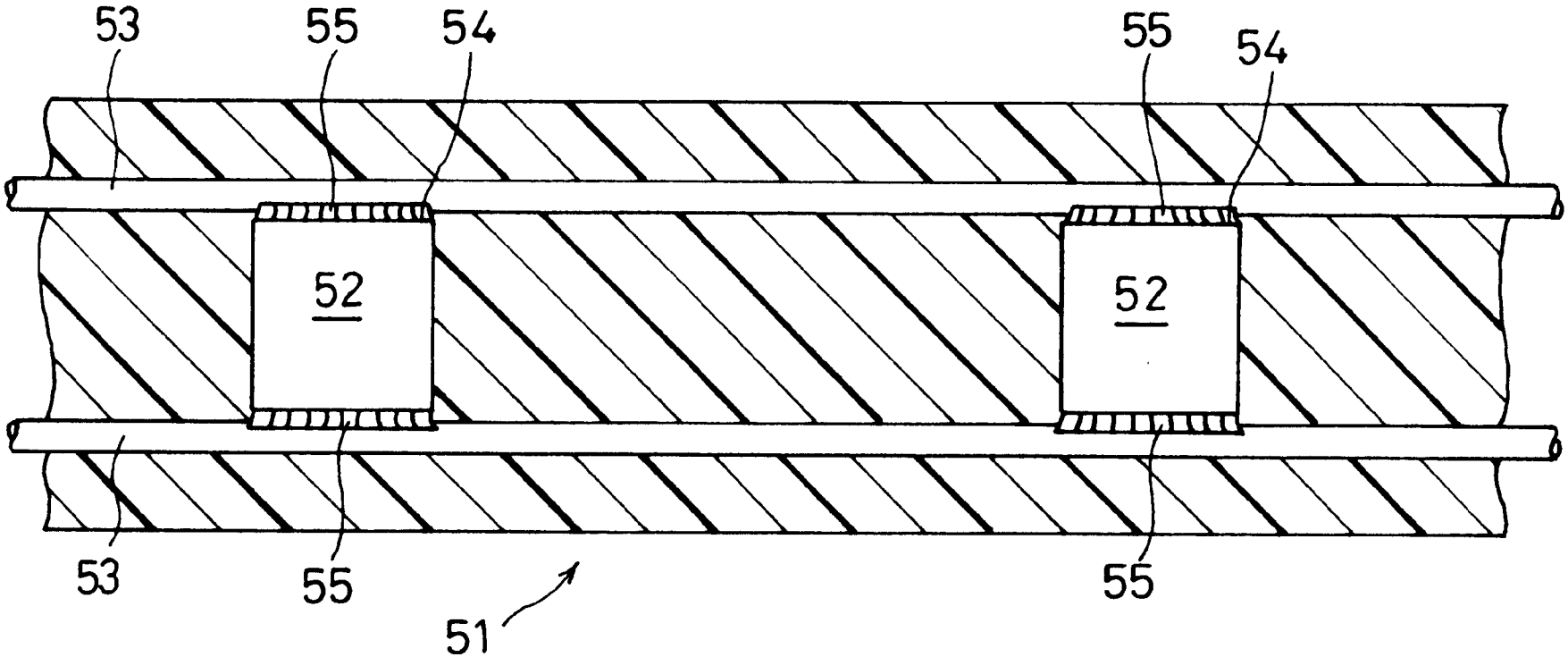
FIG. 41 is an explanatory drawing which shows another conventional heater.

In the case of using such a heating element 2', instead of the holder 5 in embodiment 1, a holder 5''' shown in FIG. 38 is used. The holder 5''' is provided with a notch Lw with its cut end width being smaller from an opening to the inside so that a bent portion of the streamlined heating element 2' is retained not to be distorted as shown by Lw in FIG. 38(*a*).

When the holder 5''' is bent along a bending line Lv, it is not always necessary that adhesive tape or an adhesive having conductivity is used for the notch and the notch is fixed with soldering because the holder 5''' is punched so that the heating element retaining piece 33 comes in contact with the bottom section 32 without a gap.

As shown in FIG. 33, when the feeders 3 are connected respectively to the heating elements 2' by using the holders 5''' manufactured in the above manner, after a portion where the electrode 7 of the heating element 2' is formed is sandwiched by the heating element retaining pieces 33 so that the heating element retaining pieces 33 come in contact with the electrode 7, the feeders 3 are fastened by the feeder retaining pieces 34 which are projected to the outside of the heating elements 2', and the feeder retaining pieces 34 are bent along the circumferential direction of the feeder 3 so as to retain the feeders 3.

The feeder retaining pieces 34 and the feeders 3 are fixed with solder, and contact portions between the heating element retaining pieces 33, the bottom sections 32 and the heating elements 2' are adhered by using adhesive tape or an adhesive having conductivity and fixed by solder. As mentioned above, when the heating elements 2' are joined to the feeders 3 by the holders 5''', the joint strength between the feeders 3 and the heating elements 2' can be improved.

Even if the heating element 2' has another shapes shown in FIGS. 39(*a*), 39(*b*), 39(*c*) and 39(*d*), it can be suppressed that a convex portion is formed on the surface of the heater main body 1. As to the respective features of the shapes, in the case of the shapes shown in FIGS. 39(*a*) and 39(*c*), pressure applied to the thermoplastic resin 4' at the time of coating is reduced not only on rear sides of heating element 2*e* and 2*c* but also on front sides, thereby making it possible to prevent the convex portion from being formed on the heater main body 1 due to the heating element 2'.

In addition, in the case of the shapes shown in FIGS. 39(*b*) and 39(*d*), since the rear sides of the heating elements 2*f* and 2*d* are round, a fracture of a corner of the heating element 2' in FIG. 34 due to unexpected shock can be reduced.

In addition, as the covering member 4, materials having electrical insulation, flexibility and weather resistance can be used. The weather resistance is such a characteristic with excellent heat resistance and cold resistance and even if, for example, heating to about 50° C. and cooling to about −10° C. are repeated, a change in a material characteristic is small.

Examples of the rubber materials as the coating material 4 and the supporter 40 are, in addition to the aforementioned vinyl chloride resin, natural rubber, butadiene rubber, ethylene propylene rubber, chloroprene rubber, isoprene rubber, styrene-butadiene rubber, acrylic rubber, chlorosulfonated rubber, silicone rubber, fluorosilicone rubber and fluororesin rubber.

In addition, further examples of resin materials as the covering member 4 and the supporter 40 are a polyolefine resin such as polyethylene and polypropylene, a polyurethane resin, poly-4-methyl pentene-1, a silicone resin, a fluororesin, a polycarbonate resin, a polyamide resin, a polyphenylene oxide resin, polybutylene terephthalate, polyethylene terephthalate and a polyimide resin.

In addition, as materials of the holder 5, etc. in the aforementioned embodiments, in addition to the aforementioned copper, for example, phosphor bronze, iron, iron nickel alloy, gold, silver, aluminum, etc. can be used.

The arrangements of the aforementioned embodiments can be used for any water pipe, but they can be used most suitably for a water pipe composed of casting such as iron used in the southern part of Tohoku and in cold district of Shinshu.

This is because, if water in the above water pipe is freezed, the water pipe is heated by flowing a high electric current, and the freezed water is melted by the heating. Therefore, due to the provision of large thermal conductivity, the heat generated from the arrangements in the above embodiments obtaining the linear contact can be transferred efficiently to the whole water pipe.

In addition, the aforementioned embodiments illustrate a water pipe as a water-residence portion to which the heater of the present invention is applied, but the present invention is not limited to this. Therefore, the heater of the present invention can be used by bringing it into contact firmly with a bent outer surface of an U-shaped water sealed portion, etc. in a pump, a water tank, a drain and a drainpipe, or directly putting into water, or laying it under a side of a railway and a surface of a road. More particularly, when the heater is laid under a center line of a road, visual observation of the center line can be improved at the time of snow.

INDUSTRIAL POSSIBILITY OF THE PRESENT INVENTION

As mentioned above, the heater of the present invention is capable of heating only a desirable portion, i.e., a subject to be heated such as a water-residence portion of a water pipe, etc. through a heating element which is a positive-characteristic thermistor, and thus useless power consumption can be suppressed. Moreover, in the case where the main body is bent, insufficient feeding to the heating element, which causes a great change in a temperature, can be avoided. As a result, since the heating by the heating element can be stabilized, water freezing in the water-residence portion as a subject to be heated can be securely prevented. More specifically, the heater of the present invention is suitable for heating a curved surface of a subject to be heated.

Further, when another heater of the present invention is manufactured through the extrusion molding, by providing protective pieces to a retaining member, the heater is capable of putting the protective pieces between a die and or nipple at an extrusion exit for the extrusion molding and a heating element.

As a result, in the heater, since the contact between the heating element and the die or nipple is prevented by the protective pieces, a damage of the heating element can be avoided, and a deterioration in heating efficiency due to a damage of the heat generation can be lowered, thereby stabilizing the manufacturing of the heater.

Further, still another heater of the present invention is formed so that a thickness of a rear side of the heating element with respect to the extrusion direction of the heater becomes smaller. For this reason, the formation of a convex portion on the main body can be suppressed.

Accordingly, the contact characteristic of the main body to a subject to be heated can be improved in this heater, and thus efficiency of heating the subject to be heated by the heating element sealed into the main body can be improved.

Therefore, the heater is useful to securely prevent the freezing of water in the water-residence portion as a subject to be heated, particularly suitable for heating a curved surface of a subject to be heated.

In accordance with the manufacturing method of a heater of the present invention, since a heating unit, which can be rolled up, can be sealed into a main body by continuously extrusion-molding a thermoplastic resin or sheet molding, a main body with a long length can be easily manufactured. As a result, particularly a heater, which is suitable to heat a curved surface of a subject to be heated, can be manufactured simply.

We claim:

1. A heater comprising:

a flexible main body which is electrically insulating and flexible;

a plurality of heating elements comprising at least one ceramic which is a positive-characteristic thermistor, said heating elements being connected to said main body along a lengthwise direction of said main body;

a pair of feeders electrically connected to said heating elements, said pair of feeders being attached to said main body; and at least a pair of flexible retaining members which are electrically conductive and which are provided in said main body so as to be in contact with said feeders and said heating elements, so as to electrically connect and to flexibly retain said feeders and said heating elements by the contact.

2. The heater according to claim 1, wherein each of said pair of retaining members is provided with first retaining pieces for retaining one of said heating elements and second retaining pieces for retaining said feeders so that backs of each of the first and second retaining pieces face each other.

3. The heater according to claim 1, wherein each of said retaining members is provided with retaining pieces for retaining said feeders and said heating element.

4. The heater according to claim 1, 2 or 3, wherein each of said retaining members sandwich at least parts of said feeders and one of said heating elements to retain said feeders and heating element.

5. The heater according to claim 1, 2 or 3, wherein said feeders are aggregate wires composed by aggregating conductive wires.

6. The heater according to claim 4, wherein edges of at least one of said heating elements retained by said retaining members are chamfered.

7. The heater according to claim 1, wherein:

said main body is formed so as to have a flexible shape by extrusion-molding a thermoplastic resin, protective pieces for protecting said heating elements are respectively provided to said retaining members so as to be projected from end portions of said retaining members with respect to an extrusion direction of the extrusion molding along the extrusion direction.

8. A heater characterized in that:

a plurality of heating elements comprising positive-characteristic thermistors are sealed into flexible main body comprising a thermoplastic resin along a lengthwise direction of said main body by extrusion molding of said main body, said heating elements have a thickness at rear sides of said heating elements and become thinner at front sides of said heating elements with respect to an extrusion direction of the extrusion molding.

9. A heater according to claim 1, wherein said retaining members are metal plates.

* * * * *

UNITED STATES PATENT AND TRADEMARK OFFICE

CERTIFICATE OF CORRECTION

PATENT NO. : 5,922,233

DATED : July 13, 1999

INVENTOR(S) : OHASHI et al.

It is certified that error appears in the above-identified patent and that said Letters Patent is hereby corrected as shown below:

On the title page,
Item [73], delete "KASETHIN" and insert therefor
-- KASEIHIN --

Signed and Sealed this
Fourth Day of January, 2000

*Attest:*

*Attesting Officer*

*Acting Commissioner of Patents and Trademarks*